US012662930B2

(12) United States Patent
Liu et al.

(10) Patent No.: US 12,662,930 B2
(45) Date of Patent: Jun. 23, 2026

(54) CALIBRATING FRICTION FACTOR AND ROCK FRACTURE PROPERTIES

(71) Applicant: Schlumberger Technology Corporation, Sugar Land, TX (US)

(72) Inventors: Bo Liu, Beijing (CN); Yupeng Xu, Beijing (CN); Feng Feng, Beijing (CN); Yan Song Huang, Beijing (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 127 days.

(21) Appl. No.: 18/798,865

(22) Filed: Aug. 9, 2024

(65) Prior Publication Data

US 2025/0067163 A1 Feb. 27, 2025

Related U.S. Application Data

(60) Provisional application No. 63/578,477, filed on Aug. 24, 2023.

(51) Int. Cl.
*E21B 44/04* (2006.01)
*E21B 49/00* (2006.01)

(52) U.S. Cl.
CPC ..... *E21B 44/04* (2013.01); *E21B 49/003* (2013.01); *E21B 2200/20* (2020.05)

(58) Field of Classification Search
CPC ..... E21B 44/04; E21B 44/02; E21B 44/005; E21B 44/00; E21B 49/003; E21B 49/001;
(Continued)

(56) References Cited

U.S. PATENT DOCUMENTS

2015/0090498 A1 4/2015 Hareland
2017/0122092 A1* 5/2017 Harmer ..... E21B 47/07
(Continued)

FOREIGN PATENT DOCUMENTS

WO 2023015288 A1 2/2023

OTHER PUBLICATIONS

Aguiar R. et. al., "Drilling Optimization Using Model-Based Design and Stratigraphic Zonation: Successful Application in Brazilian Deep Water Pre-Salt Carbonate Reservoir", SPE-196057-MS, paper presented at the SPE Annual Technical Conference and Exhibition, Calgary, Alberta, Canada, 2019, 14 pages.
(Continued)

*Primary Examiner* — Mohamed Charioui
(74) *Attorney, Agent, or Firm* — Kyle R. Miiller

(57) ABSTRACT

A method for calibrating a model of a subterranean formation includes capturing one or more measurements at a surface of a wellbore that extends into a subterranean formation. The measurements include a surface torque (STOR) on a drill string that extends into the wellbore and a surface weight (SWOB) on the drill string. The method also includes determining a friction factor based upon the STOR when a drill bit is off-bottom in the wellbore. The drill bit is coupled to a lower end of the drill string. The method also includes determining a downhole torque on the drill bit (DTOR) and a downhole weight on the drill bit (DWOB) when the drill bit is on-bottom in the wellbore. The method also includes identifying a rock type in the subterranean formation based at least partially upon the friction factor, the DTOR, and the DWOB.

13 Claims, 37 Drawing Sheets

(58) Field of Classification Search
CPC .. E21B 49/00; E21B 2200/20; E21B 2200/09; E21B 2200/08; E21B 2200/06; E21B 2200/05; E21B 2200/04; E21B 2200/03; E21B 2200/02; E21B 2200/01; E21B 2200/00; E21B 43/00
See application file for complete search history.

(56) References Cited

U.S. PATENT DOCUMENTS

2020/0149384 A1* 5/2020 Benson ..... E21B 44/02
2024/0035375 A1* 2/2024 Chen ..... E21B 49/003

OTHER PUBLICATIONS

Breton, M. A. et. al., "Solving Pre-Salt Underream While Drilling Challenge: Dynamic Simulations Optimize BHA/Cutter Block Configuration Offshore Brazil", SPE-174838-MS, paper presented at the 2015 SPE Annual Technical Conference and Exhibition, Houston, Texas, USA, 11 pages.
Chen, W. et. al., "Defining Design and Optimization Method: Dynamic Simulation Model Produces Integrated BHA Solutions for Efficient Wellbore Delivery", SPE-173008-MS, paper presented at the 2015 SPE/IADC Drilling Conference and Exhibition, London, United Kingdom, 15 pages.
Hbaieb S. et. al., "Stratigraphic Zonation Applied for Drillability—Motivation and Proposed Workflow." Rio Oil Gas Expo and Conference, 2012, 7 pages.
Laosripaiboon, L. et al., "Reservoir Characteristics Interpretation by Using Down-Hole Specific Energy with Down-Hole Torque and Drag", OTC-25890-MS, presented at the Offshore Technology Conference, Houston, Texas, 2015, 10 pages.
Pabon, J. et. al., "Modeling Transient Vibrations While Drilling Using a Finite Rigid Body Approach", SPE-137754-MS, paper presented at the 2010 SPE Deepwater Drilling and Completions Conference, Galveston, TX 2010, 15 pages.
Prasad, U. et al., "An Innovative and Reliable Method of Estimating Rock Strength From Drilling Data Acquired Downhole", SPWLA 63rd Annual Symposium Transactions, Jun. 11, 2022, 18 pages.
Ritto et. al., "Non-linear dynamics of a drill-string with uncertain model of the bit-rock interaction", International Journal of Non-Linear Mechanics, 2009, 44(8), pp. 865-876.
Shen Y. et. al., "Drilling Dynamics Model to Mitigate High Frequency Torsional Oscillation", IADC/SPE-199634-MS, paper presented at the 2020 IADC/SPE International Drilling Conference and Exhibition, Galveston, Texas, USA, 22 pages.
Shi, J. et. al., "Real-Time Reamer Vibration Predicting, Monitoring, and Decision-Making using Hybrid Modeling and a Process Digital Twin", IADC/SPE-208795-MS, paper presented at the 2022 IADC/SPE International Drilling Conference and Exhibition, Galveston, Texas, USA, 25 pages.
Toader, L. et. al., "Automated Drilling Variances Detection Through Smart Alarms System", SPE-207995-MS, paper prepared for presentation at the Abu Dhabi International Petroleum Exhibition Conference, Dec. 9, 2021, official proceedings published online, 20 pages.

* cited by examiner

| CODE | COLOR | NAME | DELTA TQA | DELTA SPPA | DELTA HKLD |
|---|---|---|---|---|---|
| 0 | | DRILLING ROTATING | YES | YES | YES |
| 1 | | DRILLING SLIDING | | YES | YES |
| 2 | | SLIPS | | | |
| 3 | | REAMING | YES | YES | YES |
| 4 | | TRIPPING PUMPING | | YES | YES |
| 5 | | TRIPPING ROTATING | YES | | YES |
| 6 | | TRIPPING | | | YES |
| 7 | | BACKREAMING | YES | YES | YES |
| 8 | | PUMPING OUT | | | YES |
| 9 | | ROTATING OUT | YES | | YES |
| 10 | | TRIPPING OUT | | | YES |
| 11 | | CIRCULATING | | | YES |
| 12 | | PUMPING | | | YES |
| 13 | | ROTATING | YES | | YES |
| 14 | | STATIONARY | | | YES |
| 15 | | UNKNOWN | | | |
| 16 | | ABSENT | | | |
| 17 | | DATA GAP | | | |

FIG. 6

RUN DEPTH 25840 FT APPLIED DEPTH 25790 - 25895 FT ROCK TYPE SHALE MUD WEIGHT 11 PPG

| STATUS | SWOB(KLBF) | SRPM(C/MIN) | MRPM(C/MIN) | FLWL(GPM) | ROP(FT/HR) | STOR(KFT.IBF) | IS STEERING |
|---|---|---|---|---|---|---|---|
| OFF BOTTOM ROTATE | N/A | 163 | 0 | 407.48 | N/A | 19.219 | NO |
| ON BOTTOM DRILL | 11.914 | 159.108 | 0 | 401.66 | 54.994 | 21.568 | YES |
| ON BOTTOM DRILL | 10.089 | 158.998 | 0 | 401.66 | 55.838 | 21.775 | YES |
| ON BOTTOM DRILL | 9.343 | 159.055 | 0 | 401.66 | 52.471 | 21.791 | YES |
| ON BOTTOM DRILL | 10.961 | 158.969 | 0 | 401.66 | 57.682 | 21.833 | YES |

KNOWN FRICTION FACTOR CASING 0.15

| TFA(DEG) | CYCLE(MIN) | STEERING RATIO(%) | STICKSLIP(%) | AXIRMS(G) | BND(KFT.IBF) |
|---|---|---|---|---|---|
| N/A | N/A | N/A | N/A | N/A | N/A |
| 360 | 3 | 40 | 0.216 | 0.078 | 8.787 |
| 186 | 3 | 30 | 0.15 | 0.078 | 9.534 |
| 348 | 3 | 40 | 0.166 | 0.079 | 7.566 |
| 354 | 3 | 40 | 0.176 | 0.079 | 11.439 |

FIG. 9

TIME-BASED SURFACE DATA

FRICTION FACTOR - COME FROM OFF-BOTTOM MODE

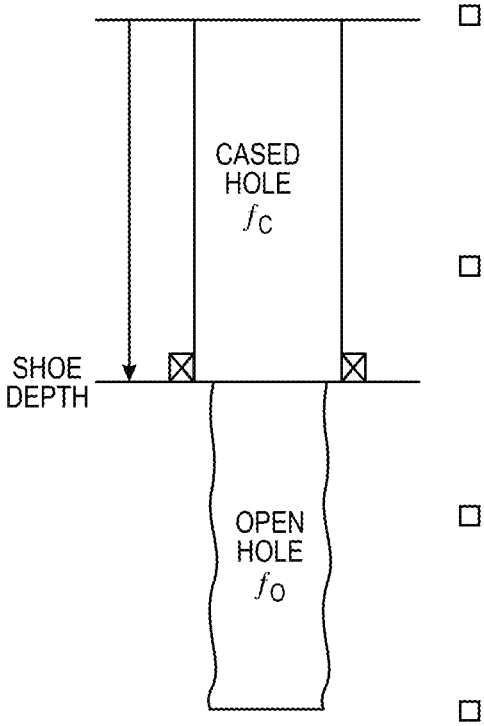

FRICTION FACTOR DISTRIBUTION

- FRICTION FACTOR DEFINITION
  - 2 ZONES: CASED HOLE, OPEN HOLE
  - DEFAULT: $f_C = 0.15$, $f_O = 0.17$

CONSTRAIN: $f_C < f_O$
- UTILIZE IDEAS2 DSDA MODEL
  - OFF-BOTTOM MODE BY WOB =0, ROP =0
  - STOR $= F_{DSDA}$ (RPM, $f_C$, $f_O$, ...)
  - CONSIDER MASS AND DAMPING EFFECTS
- ADJUST FRICTION FACTOR BY
  - OPTION 1: PREDEFINE $f_C$ AND ADJUSTING $f_O$
  - OPTION 2: PREDEFINE $f_O$ AND ADJUSTING $f_C$
- CONVERGENCE CRITERIA BY
  - $\frac{|STOR - STOR^*|}{STOR^*} < 0.001$

FIG. 16A

DRAG DISTRIBUTION ALONG DRILL STRING

TORQUE DISTRIBUTION ALONG DRILL STRING

FRICTION FACTOR- USE TO PREDICT BIT WOB AND BIT TORQUE

- PURPOSE AND OBJECTIVE
  - TRANSFER SURFACE MEASUREMENTS TO DOWNHOLE BIT
  - PREPARE BIT CONDITIONS FOR ROCK SEARCH BY IDEAS1
- UTILIZE IDEAS2 STATIC MODEL
  - DRILLING MODE BY APPLYING (BWOB, BTOR)
  - (SWOB, STOR) = $F_{STATIC}$ (BWOB, BTOR, $f_C$, $f_O$,...)
  - FAST CALCULATION THAN DSDA
- ADJUST BIT WOB AND TORQUE BY
  - ΔBWOB = SWOB* - SWOB
  - ΔBTOR = STOR* - STOR
- CONVERGENCE CRITERIA BY
  - $\frac{|SWOB-SWOB^*|}{SWOB^*} < 0.001$
  - $\frac{|STOR-STOR^*|}{STOR^*} < 0.001$

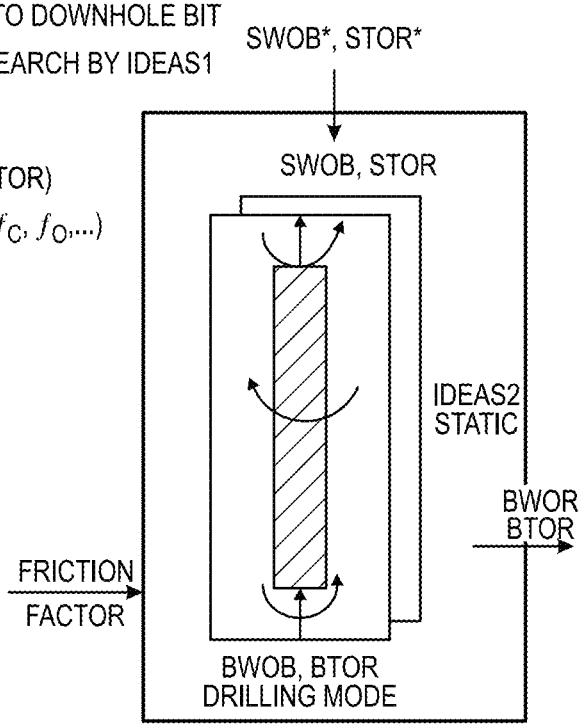

FIG. 17C

ROCK TYPE - SEARCH BY IDEAS1

- OBJECTIVE
  - DETERMINE THE BEST ROCK TO MATCH PREDICTED (BWOB, BTOR) BY IDEAS2
- CONSTRAINS:
  - UNIQUE BIT
  - CANDIDATE ROCKS
- UTILIZE IDEAS1 MODEL
  - ROP CONTROL (BWOB, BTOR) = $F_{IDEAS1}$ (ROP, RPM, BIT, ROCK)
- ADJUST PARAMETERS
  - ROCK TYPE
  - MULTIPLIER

ROCK TYPE - SEARCH ALGORITHM

I. LOOP FOR EVERY EXISTING ROCK FILE ($ROCK_J$)

I. CALCULATE $ROCK_J$ RESPONSE BY IDEAS1 FOR DRILLING OPERATION ($RPM_I, ROP_I, WOB_I, TOR_I$)
($BWOB_{IJ}$, $BTOR_{IJ}$) = $F_{IDEAS1}$ ($RPM_T$, $ROP_I$, $ROCK_J$)(I = 1,2,..., N)

II. FIND THE BEST MULTIPLIER $M_J$ MAKE THE COST CJ IS MINIMUM :

$$C_J=\frac{1}{N}\sum_{I}^{N}\left(\left(\frac{BWOB_{IJ}\cdot M_J}{WOB_I}-1\right)^2+\left(\frac{BTOR_{IJ}\cdot M_J}{TOR_I}-1\right)^2+LOG^2(M_J)\right)$$

II. SELECT THE BEST ROCK BY LOWEST COST $C_J$ $$(ROCK,M)=ARG\ MIN\ C_J$$

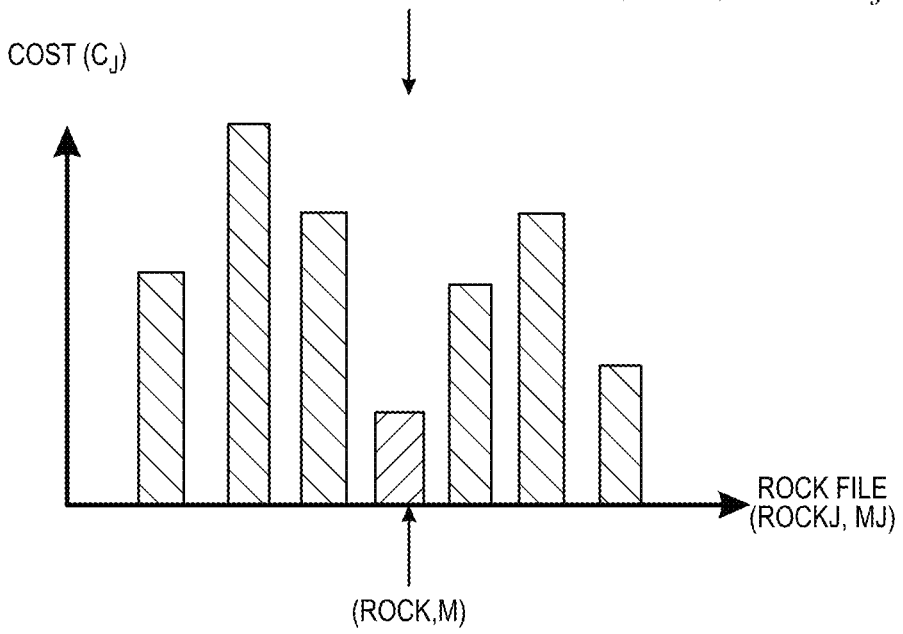

FIG. 19A

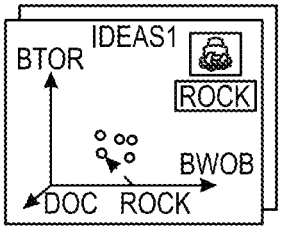

FIG. 19B

VERIFICATION - BY RUNNING IDEAS3

- PURPOSE AND OBJECTIVE
  - CERTIFICATE THE ACCURACY BY FRACTION FACTOR AND ROCK
  - RUN IDEAS3 TO EXPLORE THE GAP TO FIELD MEASUREMENT
- CONSTRAINS :
  - BIT, BHA
  - OPERATION TABLE
  - FRICTION FACTOR ($F_C$ , $F_O$)
  - ROCK SELECTION (ROCK, M)
- UTILIZE IDEAS3 MODEL
  - ROP CONTROL:

(SWOB, STOR, BWOB, BTOR ) = $F_{IDEAS3}$ (ROP, RPM, $F_C$, $F_O$, ROCK, M, ...)
- CHECK CRITERIA $$\frac{|SWOB-SWOB^*|}{SWOB^*} < 0.1 \ \& \ \frac{|STOR-STOR^*|}{STOR^*} < 0.1$$

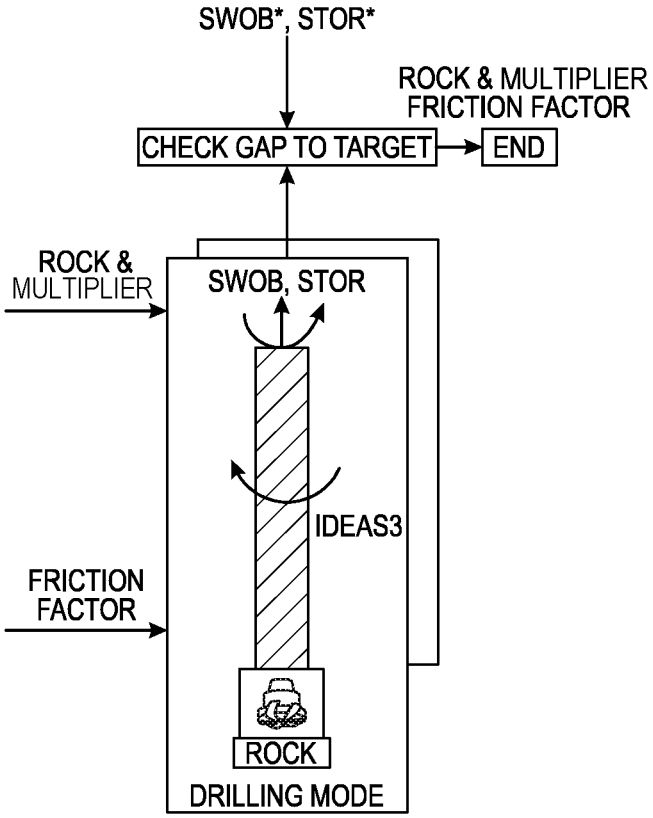

FIG. 20

CORRECTION - BY SEARCH NEW ROCK

- PURPOSE AND OBJECTIVE
  - IMPROVE THE ACCURACY FOR SELECTED ROCK
  - RETRIGGER IDEAS1 FOR NEXT STEP TO NARROW THE GAP
- PREDICT BIT WOB AND TORQUE TO IDEAS1 BY IDEAS3
  - BWOB' = (SWOB* - SWOB + W3) * RW
  - BTOR' = (STOR* - STOR + T3) * RT

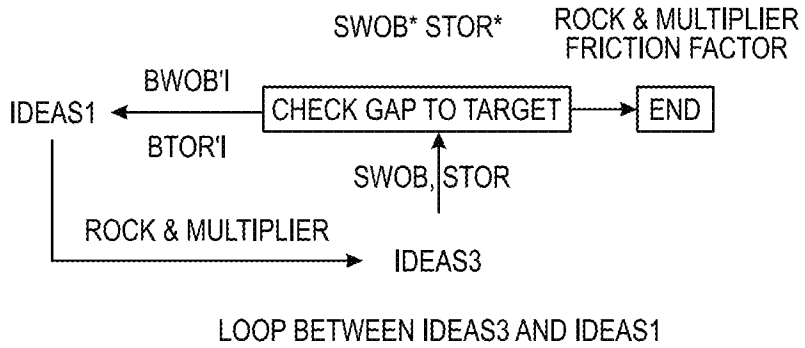

FIG. 21A

- CONVERGENCE CRITERIA BY EITHER
  - CONDITION 1: $\frac{|SWOB-SWOB^*|}{SWOB^*} < 0.1$ & $\frac{|SWOB-SWOB^*|}{SWOB^*} < 0.1$
  - CONDITION 2: MAX 6 ITERATIONS

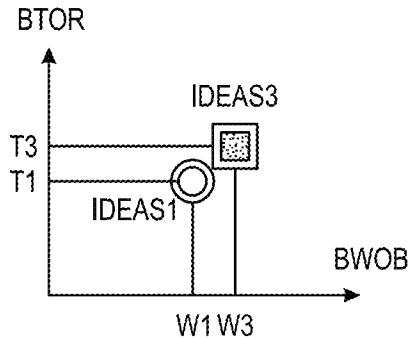

CORRECTION FACTOR: RW=W1/W3, RT=T1/T3

CORRECTION COEF. FROM IDEAS3 TO IDEAS1

FIG. 21B

TDI RESULTS ON RAW DATA

CALIBRATING FRICTION FACTOR AND ROCK FRACTURE PROPERTIES

CROSS-REFERENCE TO RELATED APPLICATIONS

This application claims priority to U.S. Provisional Patent Application No. 63/578,477, filed on Aug. 24, 2023, which is incorporated by reference.

BACKGROUND

After years of using 4D simulation for product design and cause analysis, there is a growing desire for an automated workflow that can provide a standardized and efficient calibration process for use at a wellsite. More particularly, it would be useful to reduce the reliance on manual adjustments, improve the accuracy of simulation inputs, establish a strong correlation between simulation results and field measurements, and enhance drilling performance prediction and product development.

SUMMARY

A method for calibrating a model of a subterranean formation is disclosed. The method includes capturing one or more measurements at a surface of a wellbore that extends into a subterranean formation. The measurements include a surface torque (STOR) on a drill string that extends into the wellbore and a surface weight (SWOB) on the drill string. The method also includes determining a friction factor based upon the STOR when a drill bit is off-bottom in the wellbore. The drill bit is coupled to a lower end of the drill string. The method also includes determining a downhole torque on the drill bit (DTOR) and a downhole weight on the drill bit (DWOB) when the drill bit is on-bottom in the wellbore. The method also includes identifying a rock type in the subterranean formation based at least partially upon the friction factor, the DTOR, and the DWOB.

In another embodiment, the method includes capturing one or more measurements at a surface of a wellbore. The wellbore extends into the subterranean formation. The measurements include a number of rotations per minute (RPM) of a drill string that extends into the wellbore, a surface torque (STOR) on the drill string, a surface weight (SWOB) on the drill string, and a rate of penetration (ROP) of the drill string. The method also includes determining a friction factor based upon the STOR when a drill bit is off-bottom in the wellbore. The drill bit is coupled to a lower end of the drill string. The method also includes determining a downhole torque on the drill bit (DTOR) and a downhole weight on the drill bit (DWOB) when the drill bit is on-bottom in the wellbore. The DTOR and the DWOB are determined based upon the STOR, the SWOB, and the friction factor. The method also includes simulating the drill bit drilling on-bottom through a plurality of different rock types in a model to produce a plurality of simulated torques on the drill bit (BTORs) and a plurality of simulated weights on the drill bit (BWOBs). The method also includes comparing the DTOR to the BTORs produce a first comparison. The method also includes comparing the DWOB to the BWOBs to produce a second comparison. The method also includes identifying one of the rock types based upon the first comparison and the second comparison. The identified rock type has a smallest difference between the DTOR and the BTORs, the DWOB and the BWOBs, or both. The method also includes determining a simulated surface torque (STOR') on the drill string and a simulated surface weight (SWOB') on the drill string based upon the identified rock type. The method also includes comparing the STOR to the STOR' to produce a third comparison. The method also includes comparing the SWOB to the SWOB' to produce a fourth comparison. The method also includes calibrating the friction factor to produce a calibrated friction factor based upon the third comparison and the fourth comparison. The method also includes calibrating the rock type to produce a calibrated rock type based upon the third comparison and the fourth comparison. The method also includes performing a wellsite action based upon the calibrated friction factor and the calibrated rock type. The wellsite action includes varying the number of RPM, varying the STOR, varying the SWOB, varying the ROP, or a combination thereof.

A computing system is also disclosed. The computing system includes one or more processors and a memory system. The memory system includes one or more non-transitory computer-readable media storing instructions that, when executed by at least one of the one or more processors, cause the computing system to perform operations. The operations include capturing one or more measurements at a surface of a wellbore. The wellbore extends into the subterranean formation. The measurements include a number of rotations per minute (RPM) of a drill string that extends into the wellbore, a surface torque (STOR) on the drill string, a surface weight (SWOB) on the drill string, and a rate of penetration (ROP) of the drill string. The operations also include determining a friction factor based upon the STOR when a drill bit is off-bottom in the wellbore. The drill bit is coupled to a lower end of the drill string. The operations also include determining a downhole torque on the drill bit (DTOR) and a downhole weight on the drill bit (DWOB) when the drill bit is on-bottom in the wellbore. The DTOR and the DWOB are determined based upon the STOR, the SWOB, and the friction factor. The operations also include simulating the drill bit drilling on-bottom through a plurality of different rock types in a model to produce a plurality of simulated torques on the drill bit (BTORs) and a plurality of simulated weights on the drill bit (BWOBs). The operations also include comparing the DTOR to the BTORs produce a first comparison. The operations also include comparing the DWOB to the BWOBs to produce a second comparison. The operations also include identifying one of the rock types based upon the first comparison and the second comparison. The identified rock type has a smallest difference between the DTOR and the BTORs, the DWOB and the BWOBs, or both. The operations also include determining a simulated surface torque (STOR') on the drill string and a simulated surface weight (SWOB') on the drill string based upon the identified rock type. The operations also include comparing the STOR to the STOR' to produce a third comparison. The operations also include comparing the SWOB to the SWOB' to produce a fourth comparison. The operations also include calibrating the friction factor to produce a calibrated friction factor based upon the third comparison and the fourth comparison. The operations also include calibrating the rock type to produce a calibrated rock type based upon the third comparison and the fourth comparison. The operations also include performing a wellsite action based upon the calibrated friction factor and the calibrated rock type. The wellsite action includes varying the number of RPM, varying the STOR, varying the SWOB, varying the ROP, or a combination thereof.

A non-transitory computer-readable medium is also disclosed. The medium stores instructions that, when executed by one or more processors of a computing system, cause the computing system to perform operations. The operations include capturing one or more measurements at a surface of a wellbore. The wellbore extends into the subterranean formation. The measurements include a number of rotations per minute (RPM) of a drill string that extends into the wellbore, a surface torque (STOR) on the drill string, a surface weight (SWOB) on the drill string, and a rate of penetration (ROP) of the drill string. The operations also include determining a friction factor based upon the STOR when a drill bit is off-bottom in the wellbore. The drill bit is coupled to a lower end of the drill string. The operations also include determining a downhole torque on the drill bit (DTOR) and a downhole weight on the drill bit (DWOB) when the drill bit is on-bottom in the wellbore. The DTOR and the DWOB are determined based upon the STOR, the SWOB, and the friction factor. The operations also include simulating the drill bit drilling on-bottom through a plurality of different rock types in a model to produce a plurality of simulated torques on the drill bit (BTORs) and a plurality of simulated weights on the drill bit (BWOBs). The operations also include comparing the DTOR to the BTORs produce a first comparison. The operations also include comparing the DWOB to the BWOBs to produce a second comparison. The operations also include identifying one of the rock types based upon the first comparison and the second comparison. The identified rock type has a smallest difference between the DTOR and the BTORs, the DWOB and the BWOBs, or both. The operations also include determining a simulated surface torque (STOR') on the drill string and a simulated surface weight (SWOB') on the drill string based upon the identified rock type. The operations also include comparing the STOR to the STOR' to produce a third comparison. The operations also include comparing the SWOB to the SWOB' to produce a fourth comparison. The operations also include calibrating the friction factor to produce a calibrated friction factor based upon the third comparison and the fourth comparison. The operations also include calibrating the rock type to produce a calibrated rock type based upon the third comparison and the fourth comparison. The operations also include performing a wellsite action based upon the calibrated friction factor and the calibrated rock type. The wellsite action includes varying the number of RPM, varying the STOR, varying the SWOB, varying the ROP, or a combination thereof.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures:

FIG. 6 illustrates a chart showing a plurality of drilling states, according to an embodiment.

FIG. 9 illustrates a chart showing a plurality of calibration points, according to an embodiment.

FIGS. 16A-16C illustrate more detailed schematic views of a portion of the method (e.g., determining and/or calibrating the friction factor as the downhole tool transitions from an off-bottom mode), according to an embodiment.

FIGS. 17A-17C illustrate more detailed schematic views of a portion of the method (e.g., predicting a weight on a drill bit (WOB) and torque on the drill bit based upon the friction factor), according to an embodiment.

FIGS. 19A-19D illustrate more detailed schematic views of a portion of the method (e.g., determining a rock type), according to an embodiment.

FIG. 20 illustrates a more detailed schematic view of a portion of the method (e.g., verifying an accuracy of a determined friction factor and rock type), according to an embodiment.

FIGS. 21A and 21B illustrate more detailed schematic views of a portion of the method (e.g., improving an accuracy of the selected rock type), according to an embodiment.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

Figure 1:
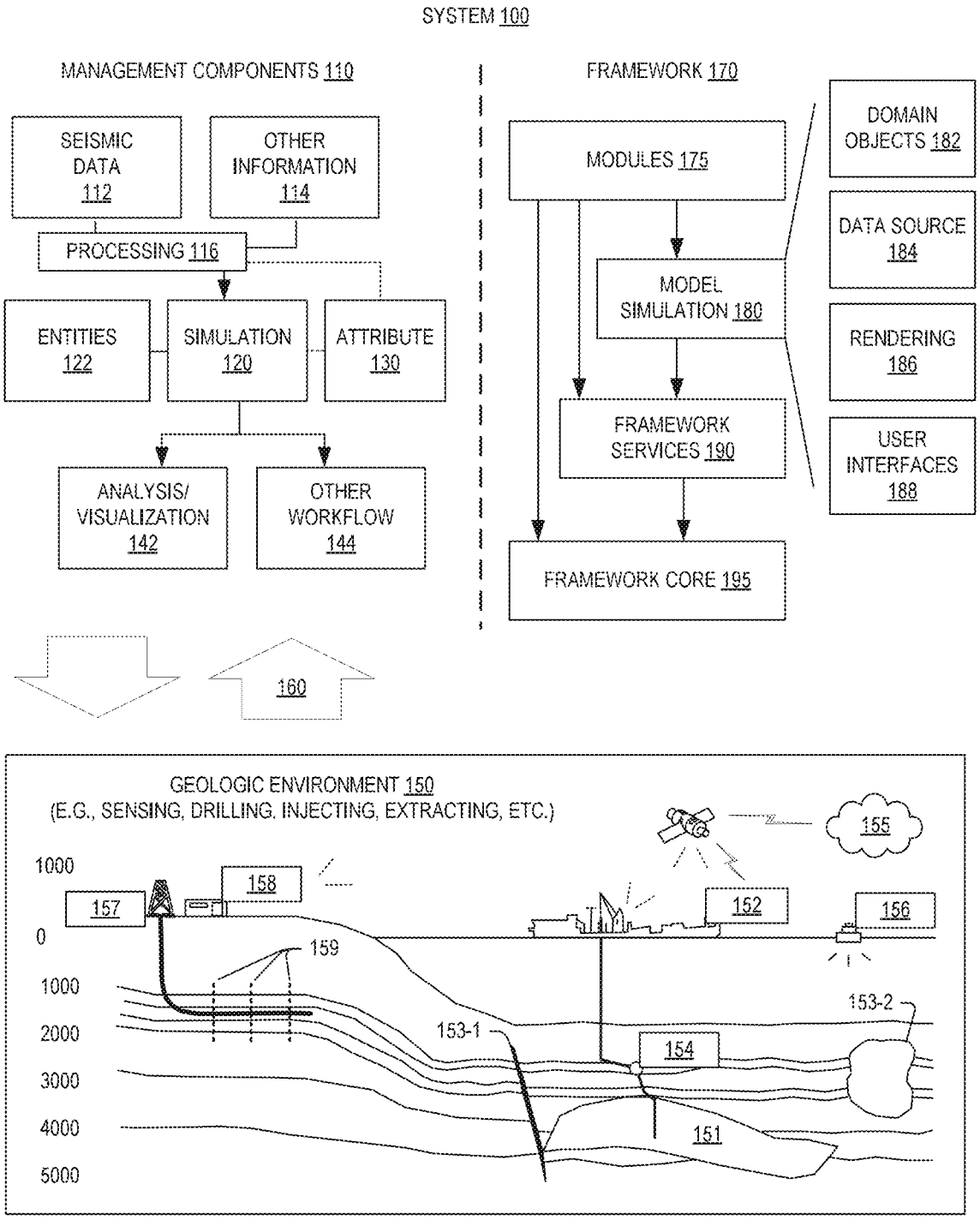
FIG. 1 illustrates an example of a system that includes various management components to manage various aspects of a geologic environment, according to an embodiment.

FIG. 1 illustrates an example of a system 100 that includes various management components 110 to manage various aspects of a geologic environment 150 (e.g., an environment that includes a sedimentary basin, a reservoir 151, one or more faults 153-1, one or more geobodies 153-2, etc.). For example, the management components 110 may allow for direct or indirect management of sensing, drilling, injecting, extracting, etc., with respect to the geologic environment 150. In turn, further information about the geologic environment 150 may become available as feedback 160 (e.g., optionally as input to one or more of the management components 110).

In the example of FIG. 1, the management components 110 include a seismic data component 112, an additional information component 114 (e.g., well/logging data), a processing component 116, a simulation component 120, an attribute component 130, an analysis/visualization component 142 and a workflow component 144. In operation, seismic data and other information provided per the components 112 and 114 may be input to the simulation component 120.

In an example embodiment, the simulation component 120 may rely on entities 122.

Entities 122 may include earth entities or geological objects such as wells, surfaces, bodies, reservoirs, etc. In the system 100, the entities 122 can include virtual representations of actual physical entities that are reconstructed for purposes of simulation. The entities 122 may include entities based on data acquired via sensing, observation, etc. (e.g., the seismic data 112 and other information 114). An entity may be characterized by one or more properties (e.g., a geometrical pillar grid entity of an earth model may be characterized by a porosity property). Such properties may represent one or more measurements (e.g., acquired data), calculations, etc.

In an example embodiment, the simulation component 120 may operate in conjunction with a software framework such as an object-based framework. In such a framework, entities may include entities based on pre-defined classes to facilitate modeling and simulation. A commercially available example of an object-based framework is the MICROSOFT®.NET® framework (Redmond, Washington), which provides a set of extensible object classes. In the .NET® framework, an object class encapsulates a module of reusable code and associated data structures. Object classes can be used to instantiate object instances for use in by a program, script, etc. For example, borehole classes may define objects for representing boreholes based on well data.

In the example of FIG. 1, the simulation component 120 may process information to conform to one or more attributes specified by the attribute component 130, which may include a library of attributes. Such processing may occur prior to input to the simulation component 120 (e.g., consider the processing component 116). As an example, the simulation component 120 may perform operations on input information based on one or more attributes specified by the attribute component 130. In an example embodiment, the simulation component 120 may construct one or more models of the geologic environment 150, which may be relied on to simulate behavior of the geologic environment 150 (e.g., responsive to one or more acts, whether natural or artificial). In the example of FIG. 1, the analysis/visualization component 142 may allow for interaction with a model or model-based results (e.g., simulation results, etc.). As an example, output from the simulation component 120 may be input to one or more other workflows, as indicated by a workflow component 144.

As an example, the simulation component 120 may include one or more features of a simulator such as the ECLIPSE™ reservoir simulator (Schlumberger Limited, Houston Texas), the INTERSECT™ reservoir simulator (Schlumberger Limited, Houston Texas), etc. As an example, a simulation component, a simulator, etc. may include features to implement one or more meshless techniques (e.g., to solve one or more equations, etc.). As an example, a reservoir or reservoirs may be simulated with respect to one or more enhanced recovery techniques (e.g., consider a thermal process such as SAGD, etc.).

In an example embodiment, the management components 110 may include features of a commercially available framework such as the PETREL® seismic to simulation software framework (Schlumberger Limited, Houston, Texas). The PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, and reservoir engineers) can develop collaborative workflows and integrate operations to streamline processes. Such a framework may be considered an application and may be considered a data-driven application (e.g., where data is input for purposes of modeling, simulating, etc.).

In an example embodiment, various aspects of the management components 110 may include add-ons or plug-ins that operate according to specifications of a framework environment. For example, a commercially available framework environment marketed as the OCEAN® framework environment (Schlumberger Limited, Houston, Texas) allows for integration of add-ons (or plug-ins) into a PETREL® framework workflow. The OCEAN® framework environment leverages .NET® tools (Microsoft Corporation, Redmond, Washington) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may include the commercially available OCEAN® framework where the model simulation layer 180 is the commercially available PETREL® model-centric software package that hosts OCEAN® framework applications. In an example embodiment, the PETREL® software may be considered a data-driven application. The PETREL® software can include a framework for model building and visualization.

As an example, a framework may include features for implementing one or more mesh generation techniques. For example, a framework may include an input component for receipt of information from interpretation of seismic data, one or more attributes based at least in part on seismic data, log data, image data, etc. Such a framework may include a mesh generation component that processes input information, optionally in conjunction with other information, to generate a mesh.

In the example of FIG. 1, the model simulation layer 180 may provide domain objects 182, act as a data source 184, provide for rendering 186 and provide for various user interfaces 188. Rendering 186 may provide a graphical environment in which applications can display their data while the user interfaces 188 may provide a common look and feel for application user interface components.

As an example, the domain objects 182 can include entity objects, property objects and optionally other objects. Entity objects may be used to geometrically represent wells, surfaces, bodies, reservoirs, etc., while property objects may be used to provide property values as well as data versions and display parameters. For example, an entity object may represent a well where a property object provides log information as well as version information and display information (e.g., to display the well as part of a model).

In the example of FIG. 1, data may be stored in one or more data sources (or data stores, generally physical data storage devices), which may be at the same or different physical sites and accessible via one or more networks. The model simulation layer 180 may be configured to model projects. As such, a particular project may be stored where stored project information may include inputs, models, results and cases. Thus, upon completion of a modeling session, a user may store a project. At a later time, the project can be accessed and restored using the model simulation layer 180, which can recreate instances of the relevant domain objects.

In the example of FIG. 1, the geologic environment 150 may include layers (e.g., stratification) that include a reservoir 151 and one or more other features such as the fault 153-1, the geobody 153-2, etc. As an example, the geologic environment 150 may be outfitted with any of a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or instead include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

As mentioned, the system 100 may be used to perform one or more workflows. A workflow may be a process that includes a number of worksteps. A workstep may operate on data, for example, to create new data, to update existing data, etc. As an example, a may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable in the PETREL® software, for example, that operates on seismic data, seismic attribute(s), etc. As an example, a workflow may be a process implementable in the OCEAN® framework. As an example, a workflow may include one or more worksteps that access a module such as a plug-in (e.g., external executable code, etc.).

Simulation Model Calibration to Provide Fit-For-Basin 4D FEA Dynamic Drilling Analysis The auto-calibration process described herein incorporates various optimization techniques based on the physics and attributes of simulation engines. For instance, a grid search may be employed to modify (e.g., optimize) discrete formation descriptions using a library of test rock files, while a gradient descent may be utilized for the modification (e.g., optimization) of continuous model parameters. Furthermore, the modification of certain model parameters may be simplified by leveraging special drill state data, thereby reducing the complexity of the overall optimization process. These approaches may improve the performance of optimization, even when dealing with computationally intensive simulations.

4D FEA Dynamic Drilling Analysis

Drill String Model

Figure 2:
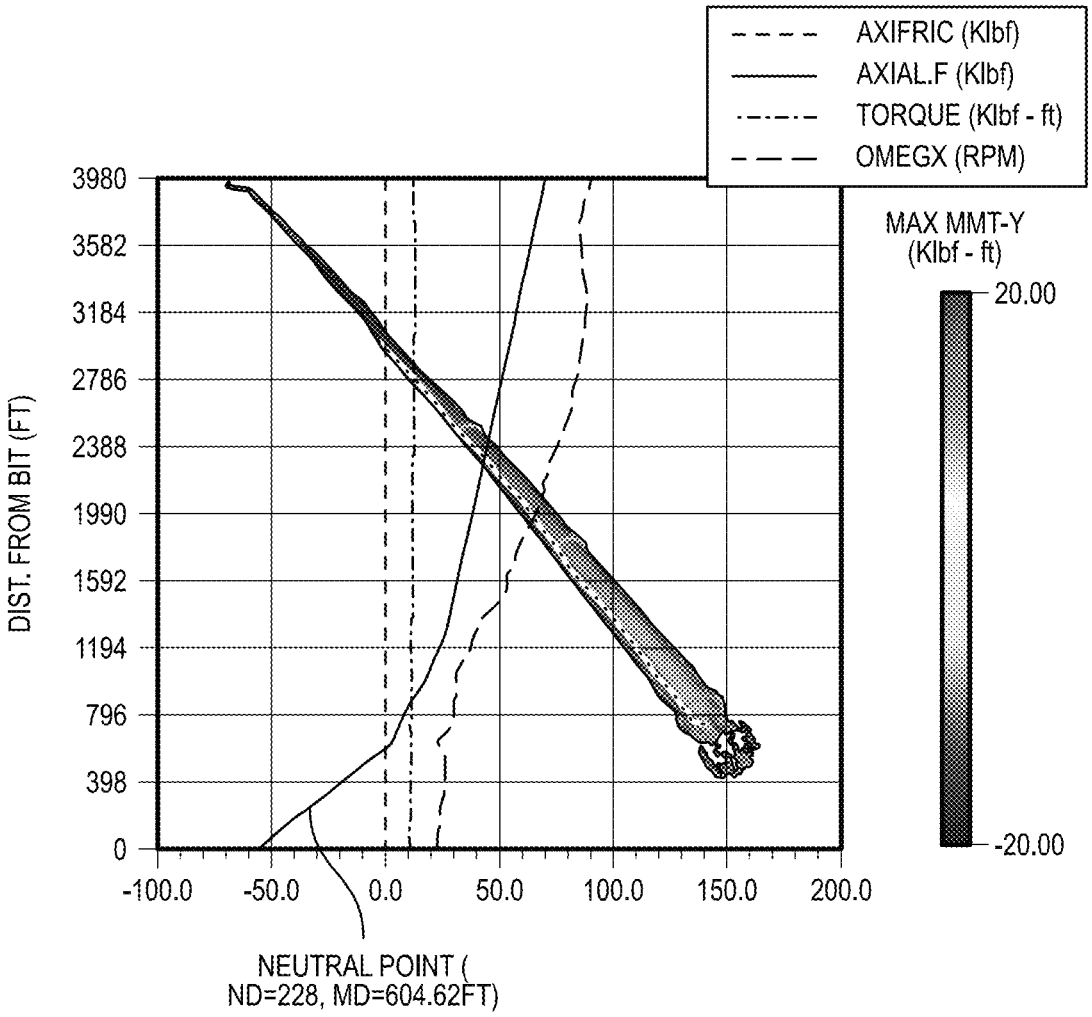
FIG. 2 illustrates a 4D finite element analysis (FEA) drilling simulation, according to an embodiment.

FIG. 2 illustrates a 4D finite element analysis (FEA) drilling simulation, according to an embodiment. The drill string is a long and slender structure assembled from various tubulars and drilling tools with complex geometry. It is subject to complex loading conditions such as gravity, wellbore contact, and the bit-rock interaction. Numerical methods are generally used to solve such problems. There have been two main discretization methods used to represent the drilling string structure: one is finite rigid body, and the other one is finite element. The model described herein uses the finite element method. The drill string may be discretized using 3D beam elements. Each beam element has two nodes, and each node has 6 degrees of freedom: 3 translations and 3 rotations. Through finite element procedures, the drilling system behavior can be described by equation 1.

$$M\ddot{u} + C\dot{u} + Ku = F(t) \tag{1}$$

where M, K, and C are mass matrix, stiffness matrix, and damping matrix; $\ddot{u}$, $\dot{u}$, and u are displacement, velocity, and acceleration vectors; and F(t) is a force vector acting on the system. The above equation can be solved using numerical integration techniques such as the Newmark method.

The wellbore contact force and friction force of the contact point can be described by equation 2.

$$F_{contact} = K_{well}\Delta r - C_{well}\dot{u} \tag{2}$$

$$F_{friction} = -\mu F_{contact}\frac{\dot{u}}{|\dot{u}|} \tag{3}$$

where $K_{well}$ and $C_{well}$ are well contact stiffness and damping coefficient; $\Delta r$ is the interference depth between wellbore and drill string; u is the velocity of the contact point; and $\mu$ is the friction factor.

Bit Rock Interaction Mode

Figure 3A:
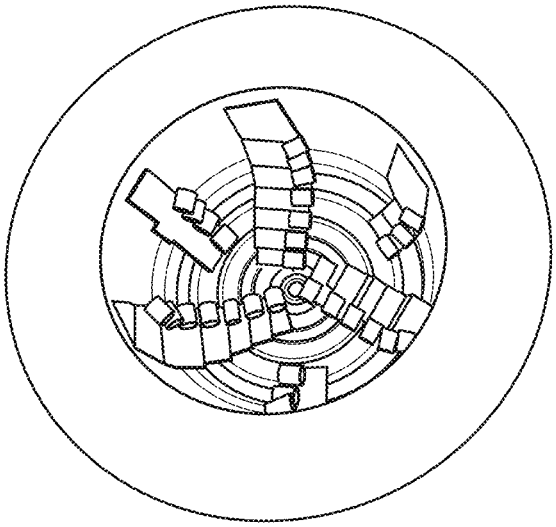
FIGS. 3A and 3B illustrate a bottom bole pattern and bit force, according to an embodiment.
Figure 3B:
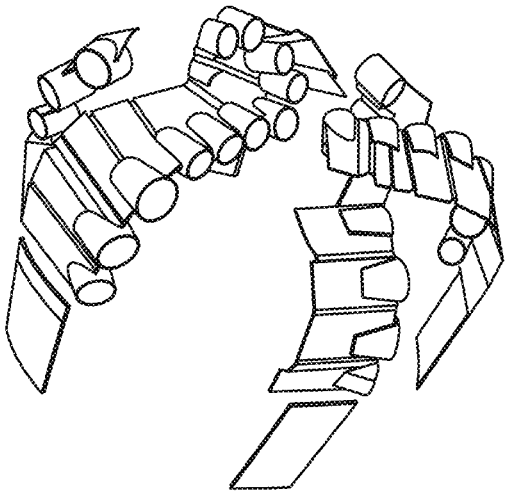
Figure 7:
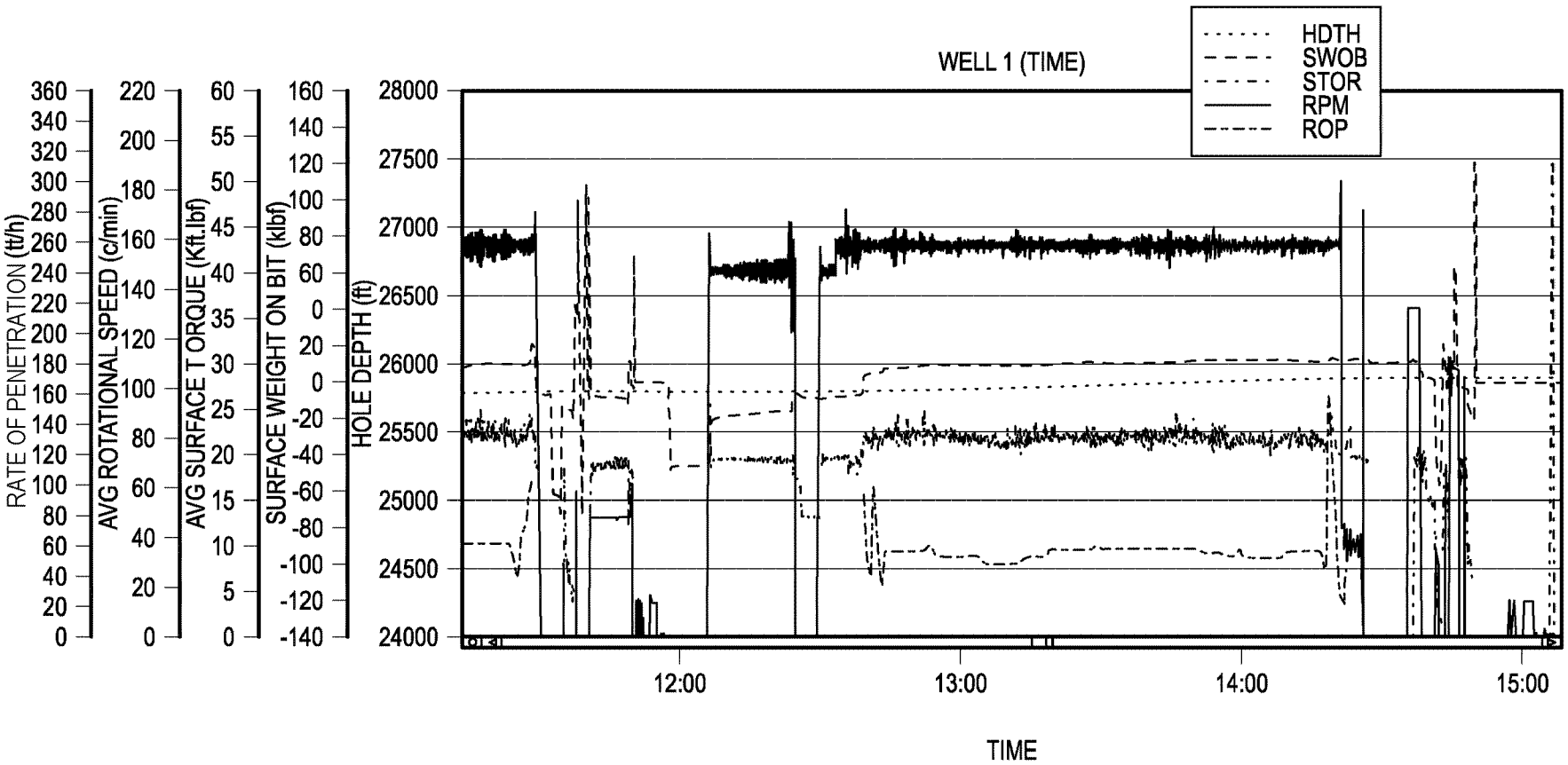
FIG. 7 illustrates a log of a plurality of field measurements, according to an embodiment.
Figure 8A:
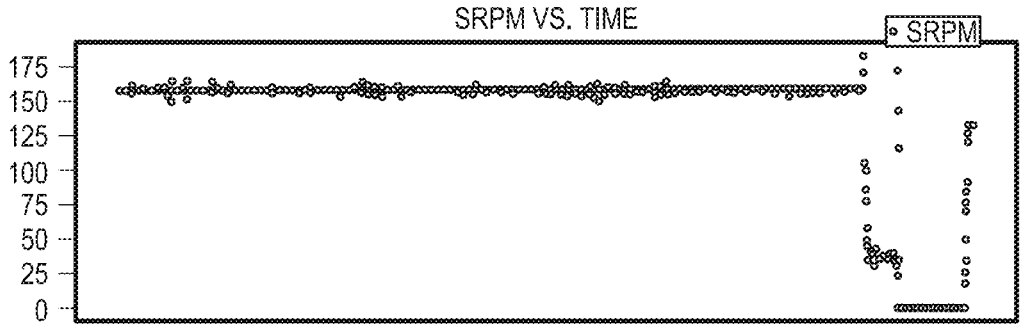
FIGS. 8A-8M illustrate a plurality of graphs showing data extraction from the field measurements for calibration points, according to an embodiment.
Figure 8B:
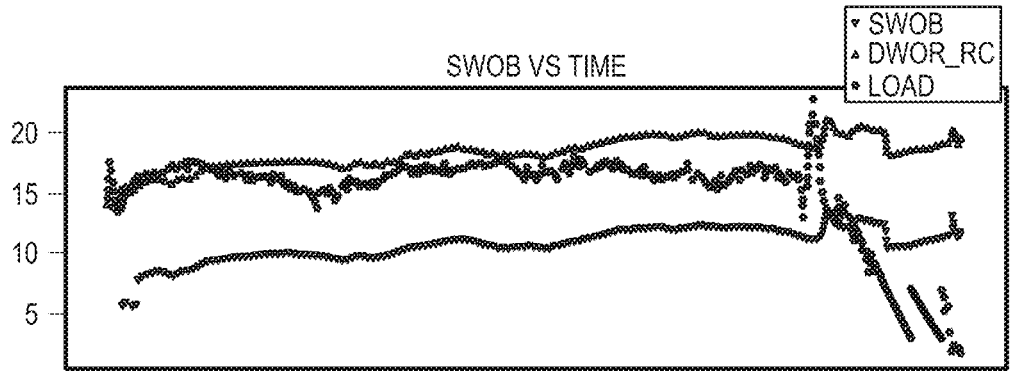
Figure 8C:
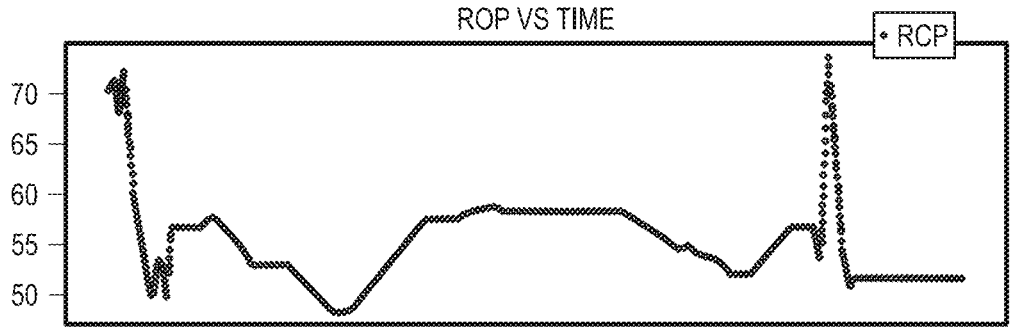
Figure 8D:
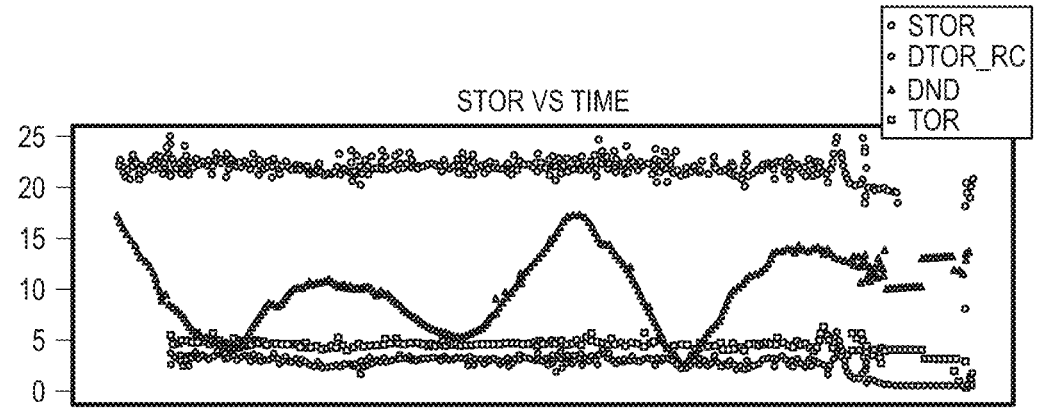
Figure 8E:
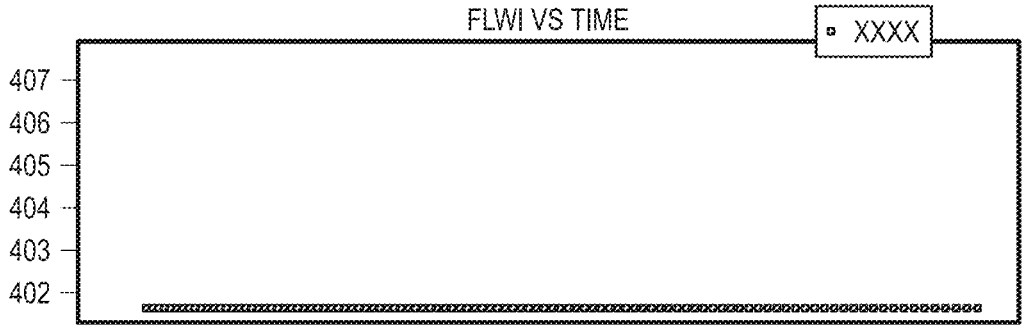
Figure 8F:
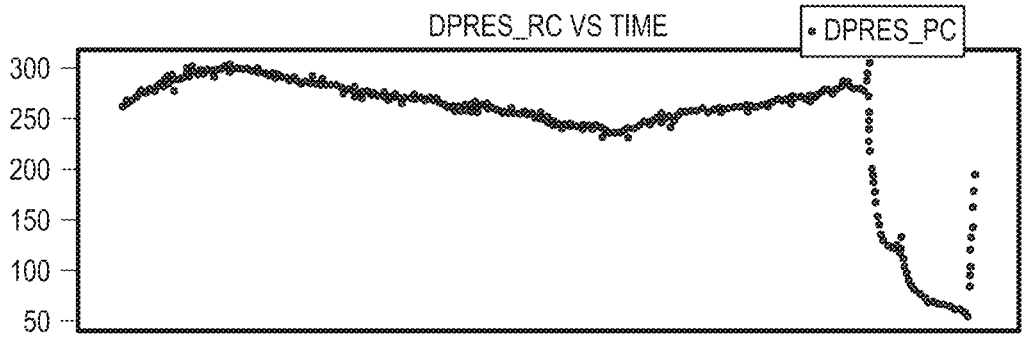
Figure 8G:
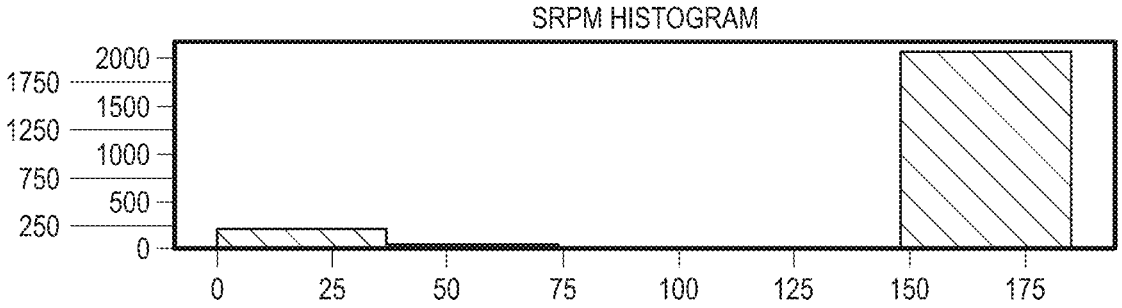
Figure 8H:
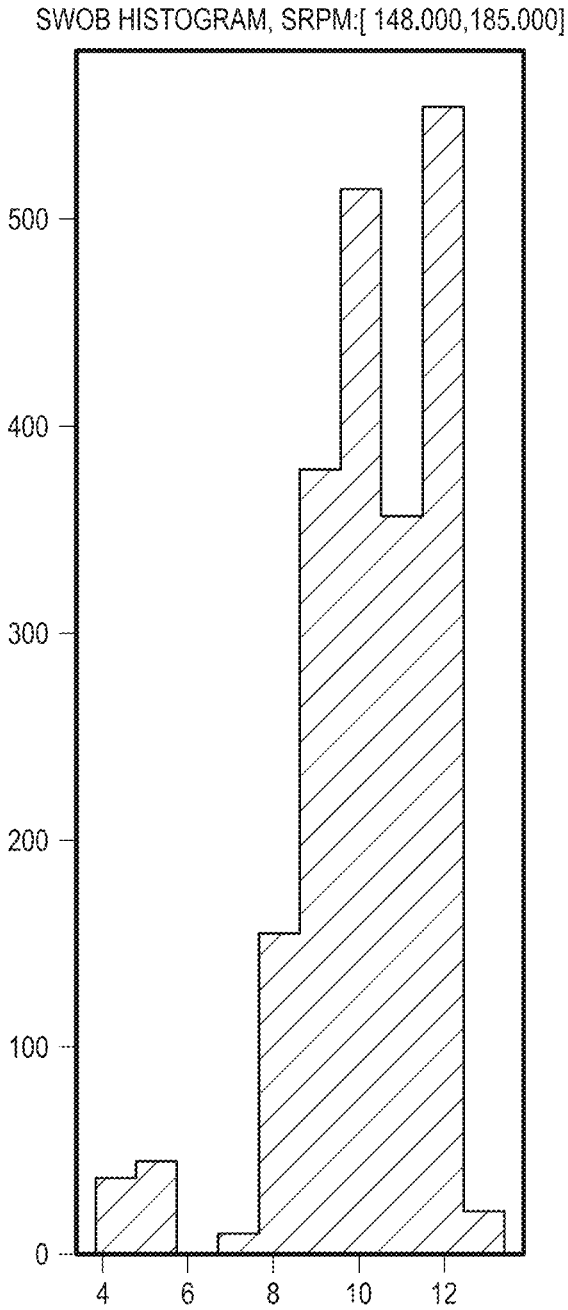
Figure 8I:
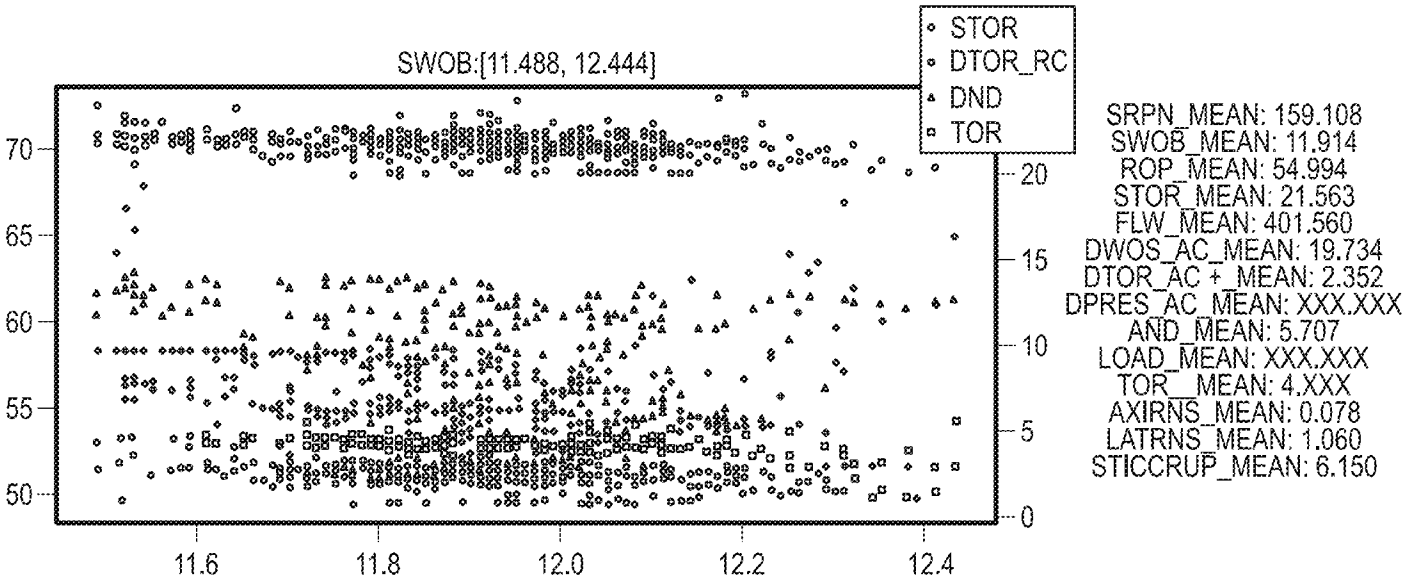
Figure 8J:
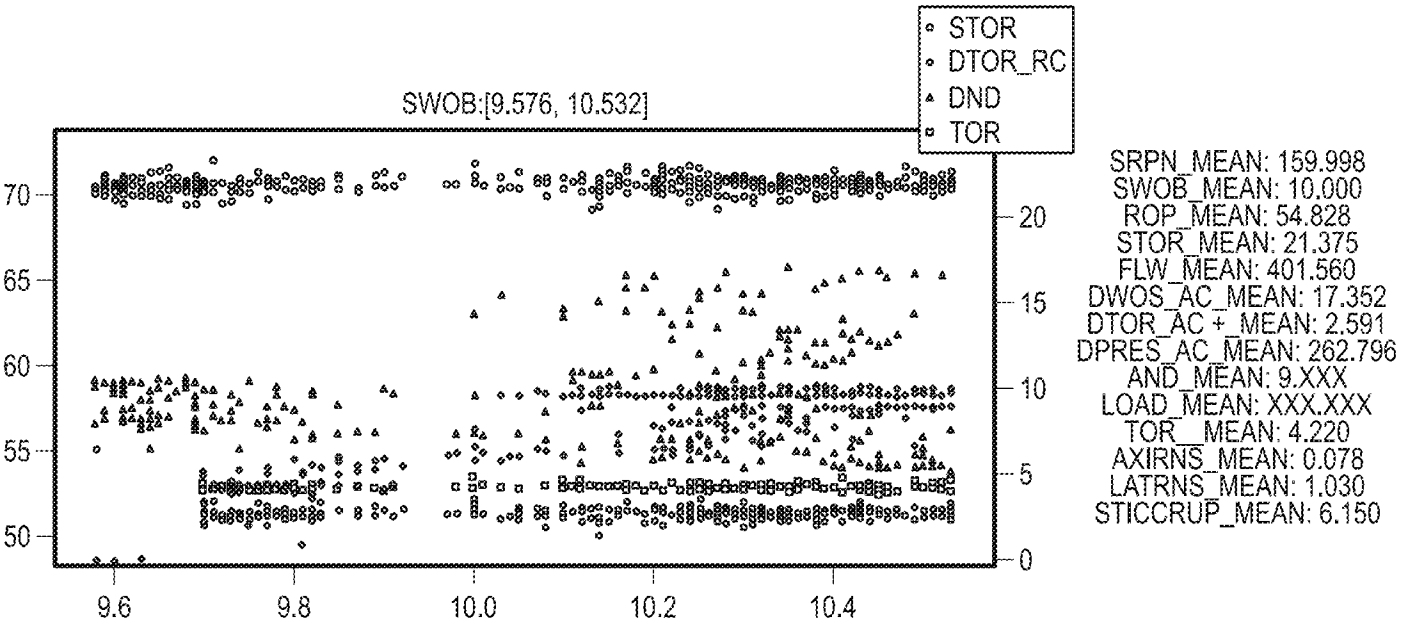
Figure 8K:
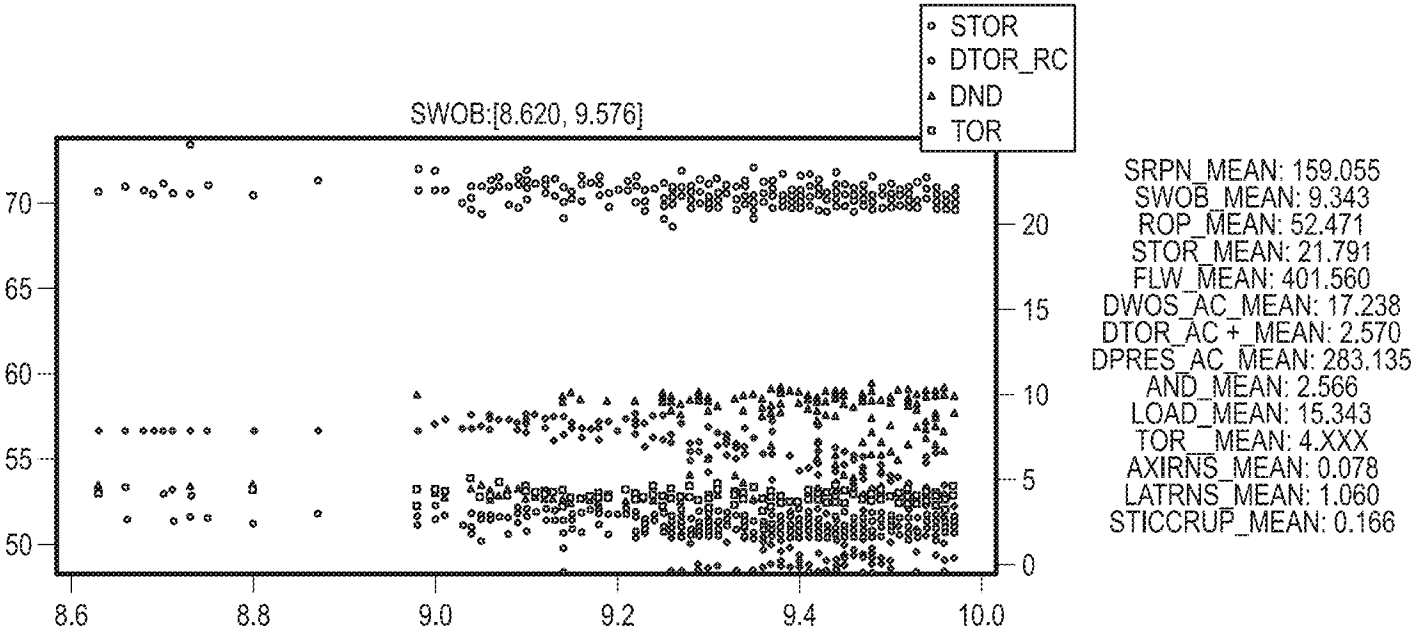
Figure 8L:
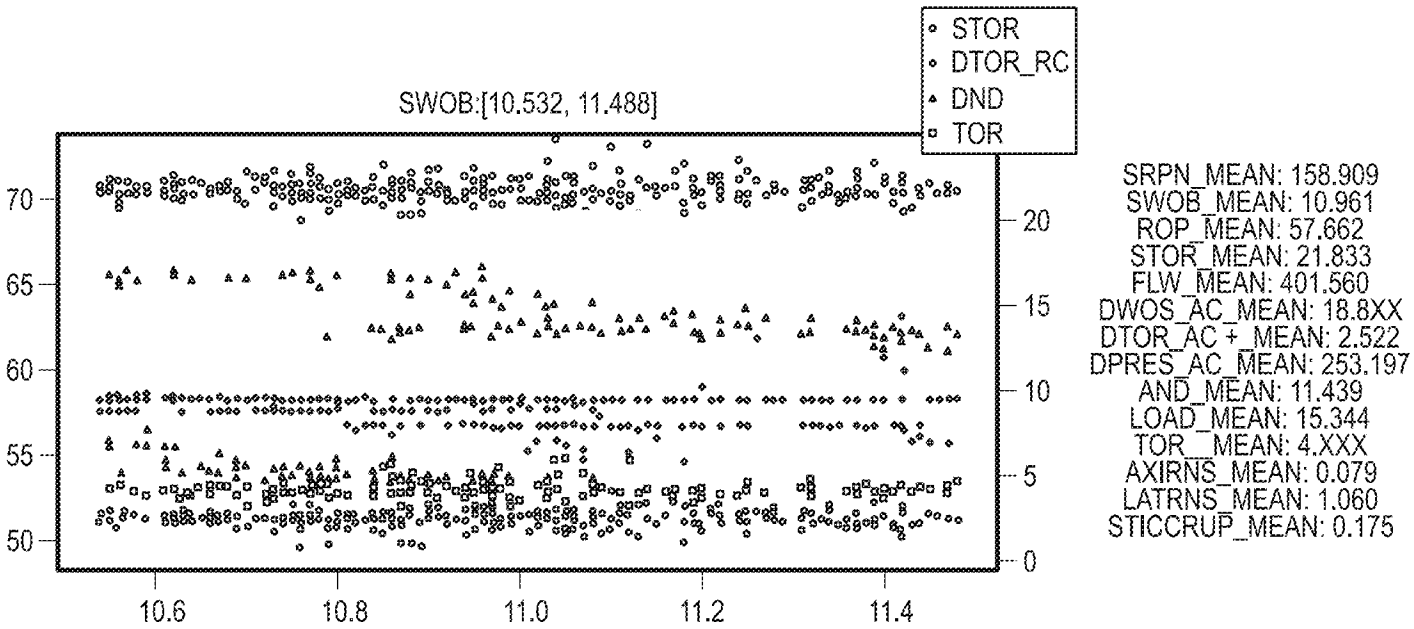
Figure 8M:
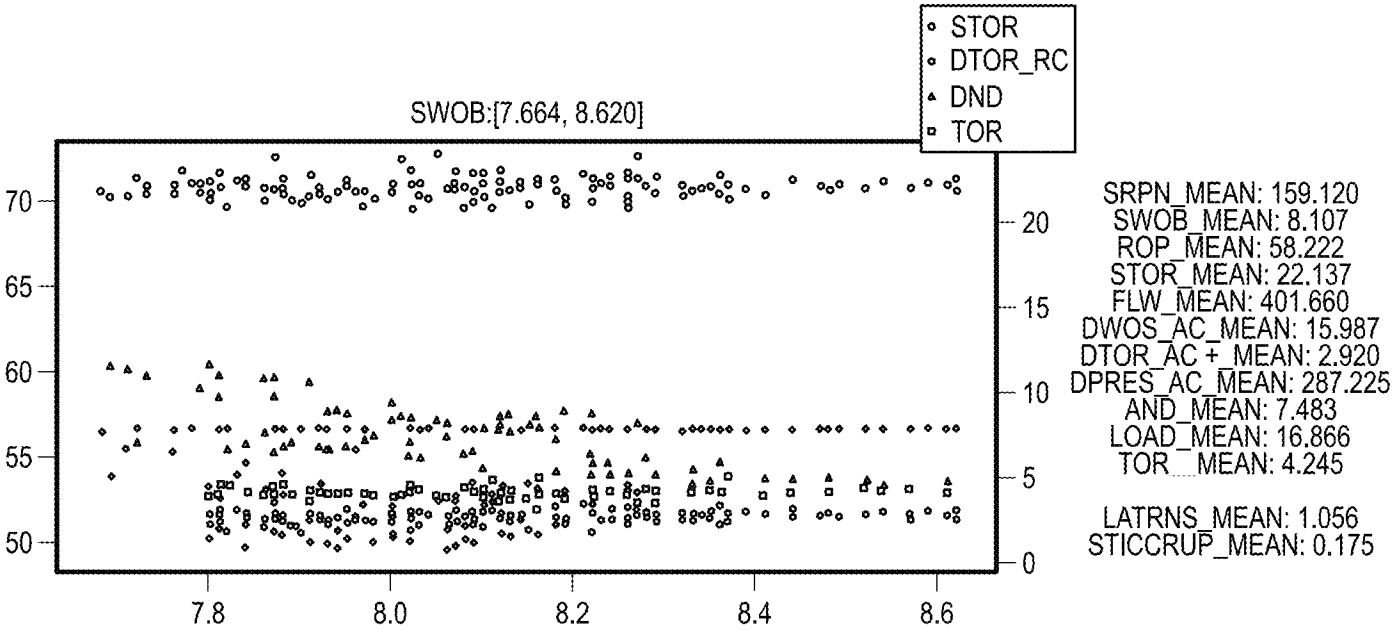

FIGS. 3A and 3B illustrate a bottom hole pattern and bit force, according to an embodiment. The bit model may start from single cutter testing (as shown in FIG. 7). A series of cutting tests may be performed to record the cutting forces for different cutter sizes, with different orientation angles, at different depths of cut, on different formations, under different confining pressures. Then, during drilling simulation, when the depth of cut for each cutter is determined, the cutting forces on each cutter can be obtained from the recorded lab testing results. The loading on the whole bit can be obtained by summation of the forces on individual cutters (as shown in FIGS. 8A-8M). Iterations may be carried out during calculation so the total loading from cutters is balanced by the applied weight on bit.

Simulation Calibration

Due to the complexity of any oil drilling operation, the heterogeneity and nonuniform nature of the formation, a workflow may be developed for a systematic drilling system optimization. One purpose of the workflow is to calibrate and validate the 4D drilling simulator software, using drilling data, mud logging, and/or wireline data through the stratigraphic zonation for drilling. As a result, a virtual carbonate formation may be created to better reproduce the actual drilling conditions in the pre-salt carbonates. Drilling dynamics simulations can predict vibration along the entire drill string with decent certainty. With the assistance of field records and careful calibration, the drilling dynamics simulations can further improve shock and vibration prediction accuracy.

Automated Simulation Model Calibration

A data-driven calibration workflow may correlate the simulation to the field measurements. The calibration workflow may include: 1) extract the calibration points from the field measurements; 2) adjust the simulation parameters; 3) run simulation, and 4) compare the simulation results and field measurements. Then, loop 2) to 4) until the error is within a predetermined error threshold or a maximum loop number is reached.

Figure 4:
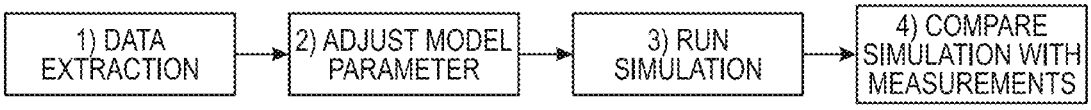
FIG. 4 illustrates a flowchart of a simulation calibration, according to an embodiment.
Figure 5:
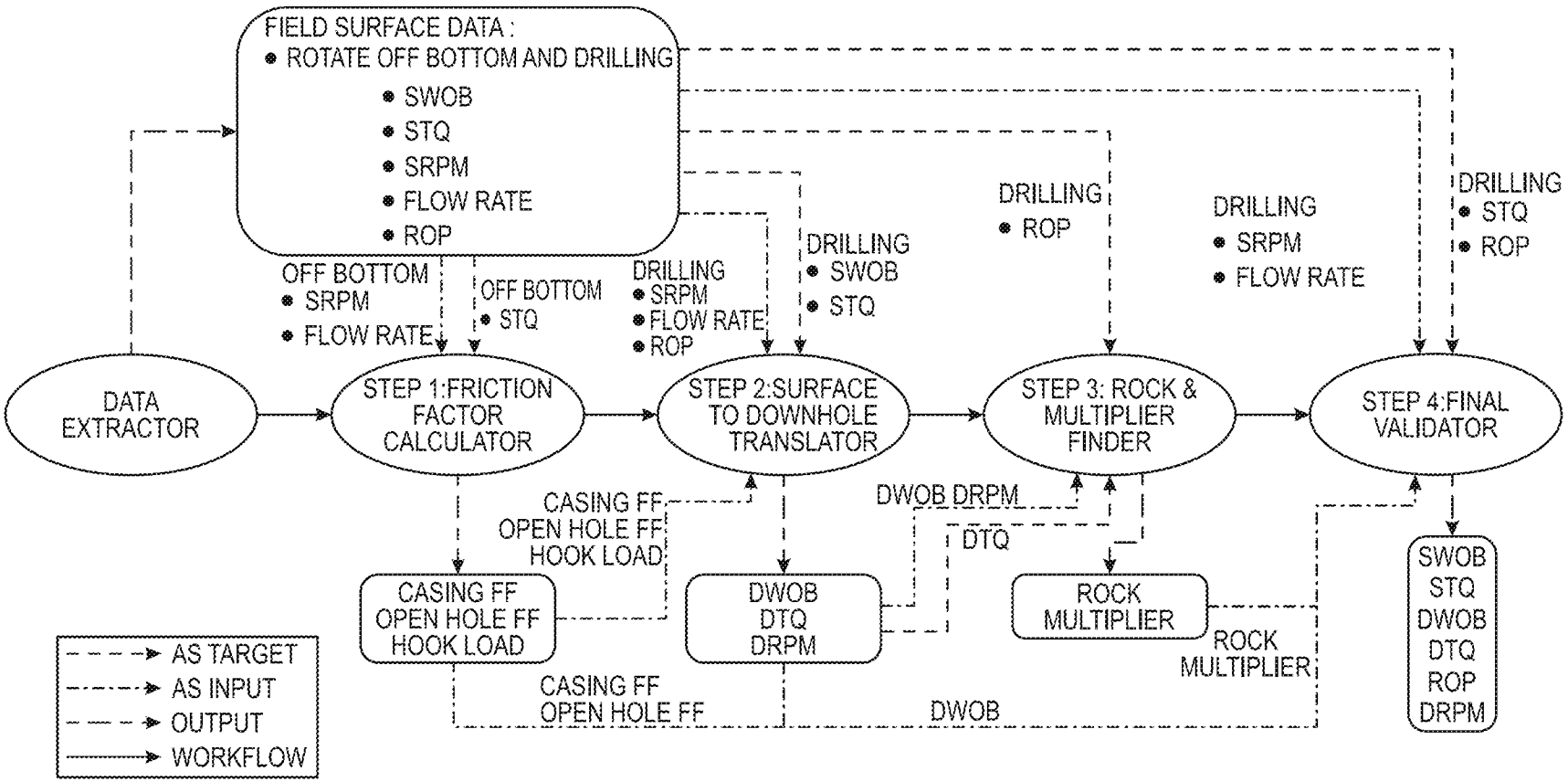
FIG. 5 illustrates a schematic view of an automated calibration workflow, according to an embodiment.

FIG. 4 illustrates a flowchart of a simulation calibration, according to an embodiment. FIG. 5 illustrates a schematic view of an overall automated calibration workflow, according to an embodiment. Due to the timelessness of the simulation, the transient stages may be skipped, and the average values or patterns may be matched. Furthermore, to overcome the complexity of drilling activities and heavy computation of dynamic drilling simulation, the whole workflow may be separated to one or more sub workflows, and each sub workflow may use similar calibration techniques as previously discussed. The operations parameters (e.g., inputs) and target are from field data or the output of previous portions of the workflow. The final output may be or include the calibrated model parameters and/or the comparison results. These sub workflows include a friction factor calculator, a surface to downhole translator, a rock and multiplier finder, and a final validator. One of the reasons to decouple the drilling process to separated drill string model and bit rock interaction model is so that the light simulator can be applied to speed up the calibration process. Another reason is to reduce the large combination of the many model parameters and options.

Friction Factor Calculator

This sub workflow takes the rotating off bottom surface rotations per minute (RPM) and the flow rate as inputs; the surface torque as a target; and a drill string model as a simulator to search for the open hole and casing hole friction factors. The side output may be the rotating off-bottom hook load. The method is adjusting the friction factor in a predetermined range, and then feeding back the responded surface torque to increase or decrease the friction factors to minimize the torque gap between simulation and measurement.

Surface to Downhole Translator

This sub workflow takes the drilling surface RPM, flow rate, rate of penetration (ROP), the open hole and casing hole friction factors, and rotating off-bottom hook load as inputs; surface weight on bit (WOB) and torque as targets; and drill string model as a simulator to search for downhole WOB and torque. The side output is downhole RPM. Here, a static model of the drill string model may be utilized to improve the performance, which generally finished within seconds for one try. Due to the detailed model of mud motor, the downhole RPM may be captured.

Rock and Multiplier Finder

This sub workflow takes the drilling surface ROP and downhole RPM as inputs; the downhole WOB and torque as targets; and the bit rock interaction model as the simulator to search for formation representation (e.g., rock and its multiplier). The available candidates of the rock lib test result for the bit may be looped in. Available candidates refer to the cutter types and/or sizes on the bit. The lithology and/or mud log results can be used for the rock selection, such as sandstone, shale, carbonates, etc. This physical understanding may reduce the searching space to reduce the time cost, and also increase the accuracy of the result by known formation descriptions, such as homogeneous or inhomogeneous rock, the percentage of the rock combinations, etc. A static model of bit rock interaction may also be utilized and run one rock with several seconds.

Validator

This drilling surface RPM, flow rate, downhole WOB, friction factors, and formation representation may be used as inputs; the surface ROP and torque may be used as targets; and the integrated drill string and bit rock interaction model may be used as the simulator to find the gap between the simulation and measurements. The model may be integrated and dynamical, which is a heavy computation and generally takes 4 to 6 hours for one simulation. With this simulator, the overall performance such as ROP and torque, as well as the drilling dynamics, such as stick-slip, shock and vibration, high frequent torsional oscillation (HFTO), may be mimicked.

There are several interactions between the rock and multiplier finder and the final validator until the gap between the simulation and measurements is within a predetermined range or a maximum of iterations is reached or the results are not improving.

Algorithms for Automated Simulation Model Calibration

Drill State to Decouple Model Parameters

FIG. 6 illustrates a chart showing a plurality of drilling states, according to an embodiment. As shown in FIG. 6, the time interval or time referenced data may be segmented into various drill states. Circulating, code of 11, for example, means the drill string is stationary with pumping and rotation. Circulating is just prior to Drilling. Drilling, code of 0, for example, means the drill string is moving down with pumping and rotation. Circulating is also referred to as rotating off bottom. It is simplified that the friction factors are the same during the circulation and drilling stage, because the mud conditions and the contact between drill string and well contact are similar for these two stages. The circulation state may be relatively simple because the drill string is stationary, which means there is no bit rock interaction. As a result, the data of the circulation state may be applied to calibrate the friction factors.

Gradient Descent for Continuous Model Parameters Space

In mathematics, gradient descent (also often called steepest descent) is a first-order iterative optimization algorithm for finding a local minimum of a differentiable function. This algorithm may be used herein for calibration. Here, the local minimum is the minimum distance between the simulation result and the field measurements. The difference function is the simulation response for the input parameters.

Using the friction factor as an example, "scipy.optimize.minimize_scalar" may be used when one friction factor is known and another is to be calibrated. The fun may call the simulator to calculate the surface torque and return the square error between the simulated and the measured surface torque with the input of the friction factor. In an example, bounds of [0.1, 0.5] may be used for drilling scenarios. The method may be "bounded," and the tol may be 1.0e-3. The optimization algorithm may then call the fun iteratively and return the friction factor within [0.1, 0.5] with the minimized difference of surface torque.

Grid Search for Discrete Formation Descriptions

As previously described, the bit rock interaction model may rely on a cutter rock interaction laboratory test. The rock samples for the laboratory test may be discrete. In addition, the confining pressures applied to the rock sample may also be discrete. The (e.g., best) matched response between the rock sample and the real formation may be the expected of the calibration workflow. No clear relationship between the rock samples and the grid search may mean that the loop of the available rocks may be used. The grid search may be performed in parallel.

Calibration Results

FIG. 7 illustrates a log of a plurality of field measurements, according to an embodiment. FIGS. 8A-8M illustrate a plurality of graphs showing data extraction from the field measurements for calibration points, according to an embodiment. FIG. 9 illustrates a chart showing a plurality of calibration points, according to an embodiment. The field measurements may be or include a surface weight on bit (SWOB), surface torque (STOR), rotations per minute (RPM), and rate of penetration (ROP). One 'data point' means one point at a specific time index, containing the measurements of that time index):

(1) As surface RPM is quite controllable and not that variable during the drill process and is more accurate compared to other measurements, first determine and/or generate a histogram on the surface rotations per minute (SRPM) for the data points of the drill stand. Then, the first one or more (e.g., two) groups (ordered by data points count) may be selected for (2) below. If the SRPM is almost constant, the data points may be selected from the next portion as one group.

(2) For each SRPM group, determine and/or generate a histogram on the surface weight on bit (SWOB) for the data points of the group. Then the first one or more (e.g., five) groups (ordered by data points count) may be selected for (3) below.

(3) For one or more (e.g., ten) groups (5 groups if one SRPM group is detected), calculate the average value of each measurement of the data points in the group, for any given logs from surface to downhole.

(4) Order the (e.g., ten) groups based on the data points count of each group.

(5) Automatically pick the first one or more (e.g., three) groups, and use the average values as the on-bottom drilling inputs. In one embodiment, each of the ten sets may be candidates, however, tests show that, in most cases, the first several groups have occupied most data points.

Figure 10A:
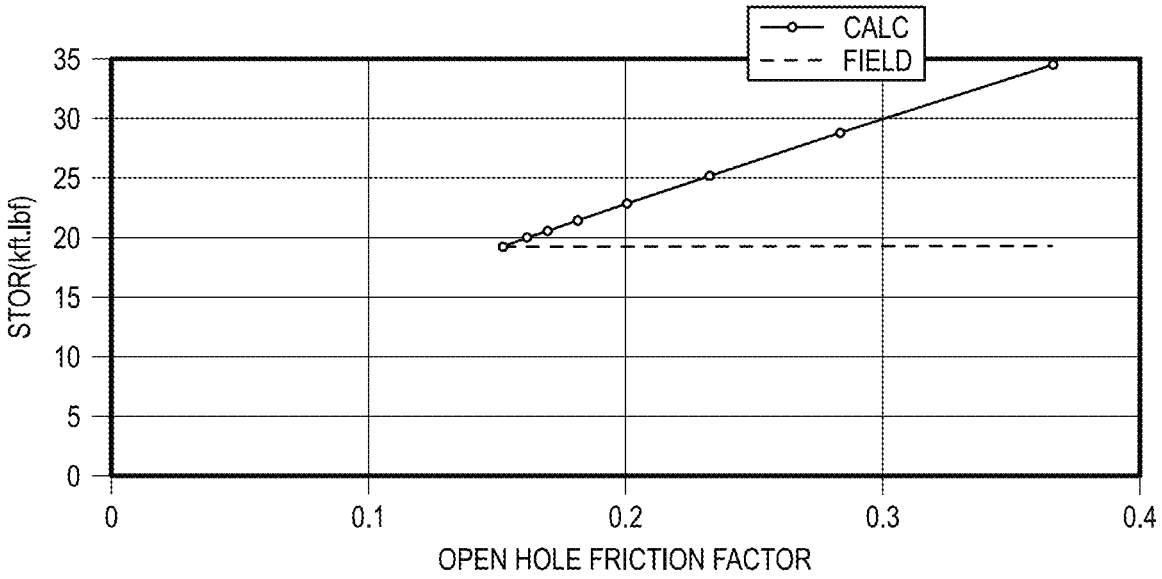
FIGS. 10A and 10B illustrate graphs showing the friction factor calibration result by the method of gradient descent, according to an embodiment.
Figure 10B:
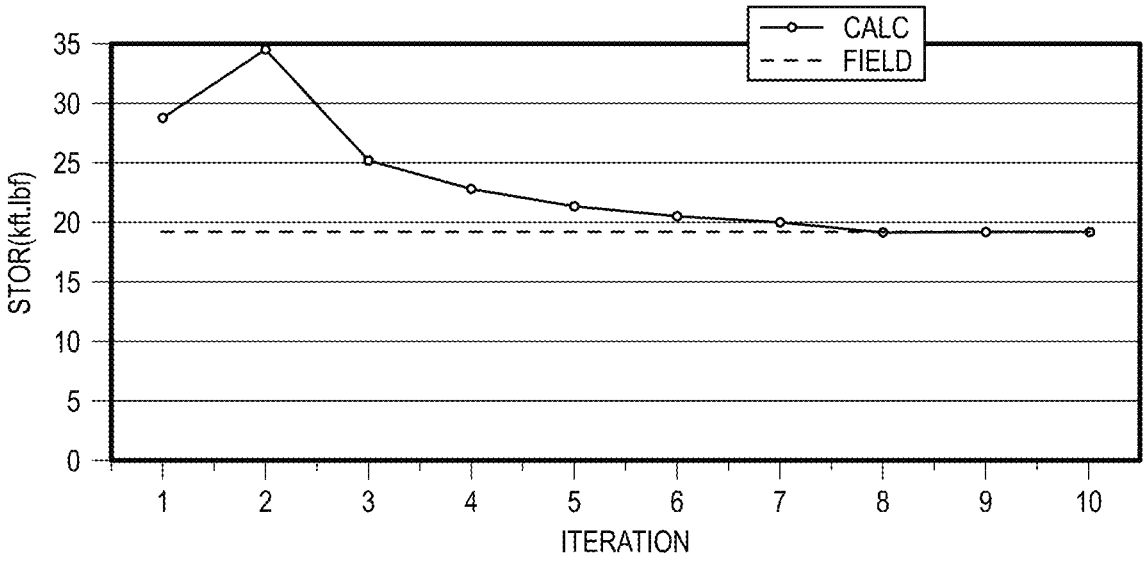

FIGS. 10A and 10B illustrate graphs showing the friction factor calibration result by the method of gradient descent, according to an embodiment. The algorithm uses a larger friction factor in the iteration in iteration #2 with the increase of the surface torque, which increases the distance between simulation and measurement. Then, it decreases the friction factor accordingly. And the intervals become smaller when the distance is smaller.

Figure 11A:
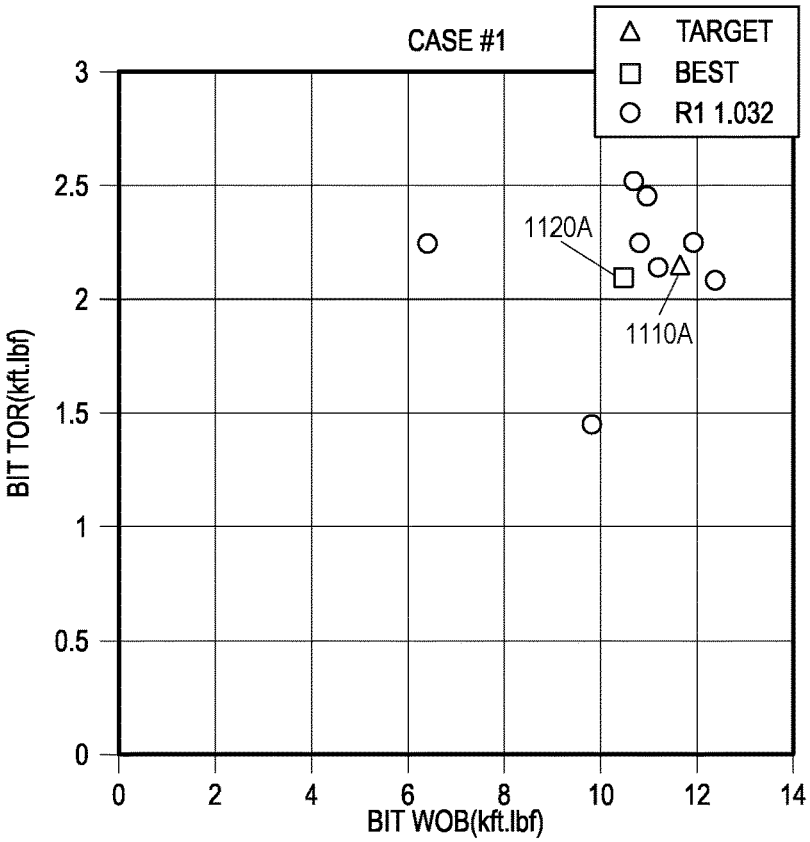
FIGS. 11A-11C illustrate graphs showing a rock and multiplier calibration result, according to an embodiment.
Figure 11B:
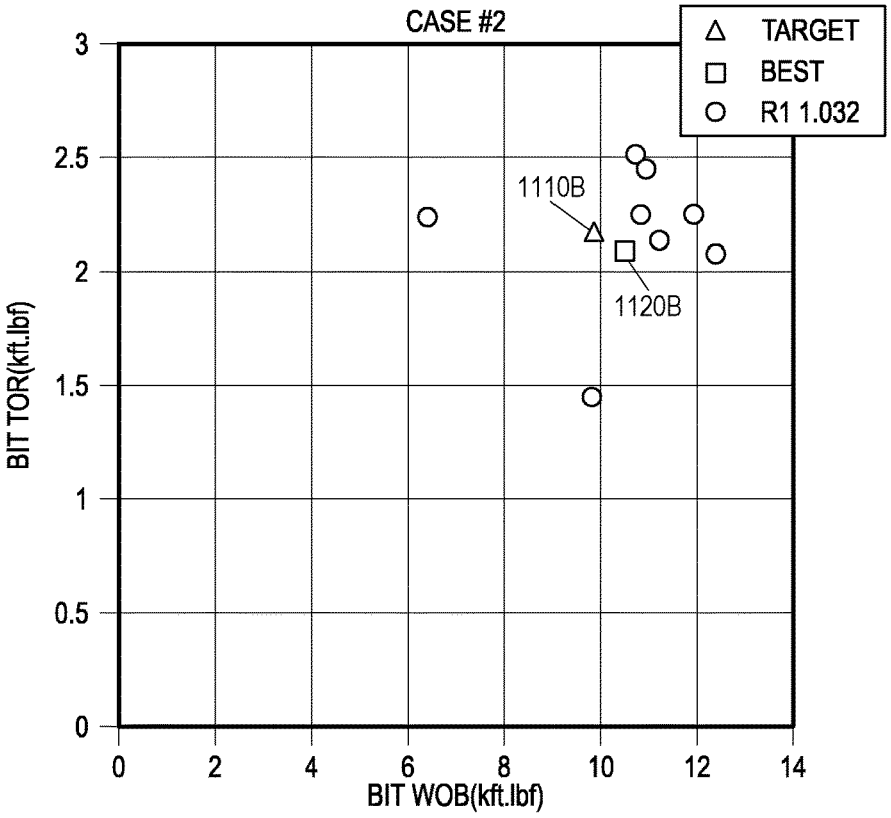
Figure 11C:
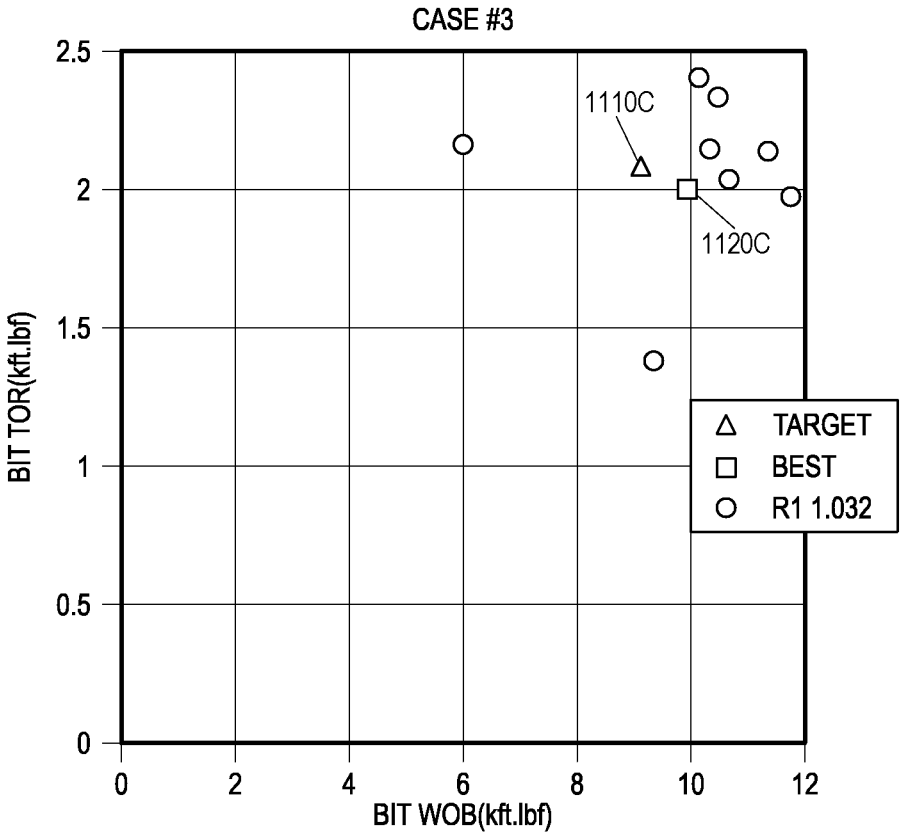

FIGS. 11A-11C illustrate graphs showing a rock and multiplier calibration result, according to an embodiment. The target points are identified by reference numbers 1110A-1110C (blue). The (e.g., best) rocks with multipliers are identified by reference numbers 1120A-1120C (green). The rocks with multipliers represent the closest points from the rock candidates, which are obtained from the grid search for the available rocks.

Figure 12:
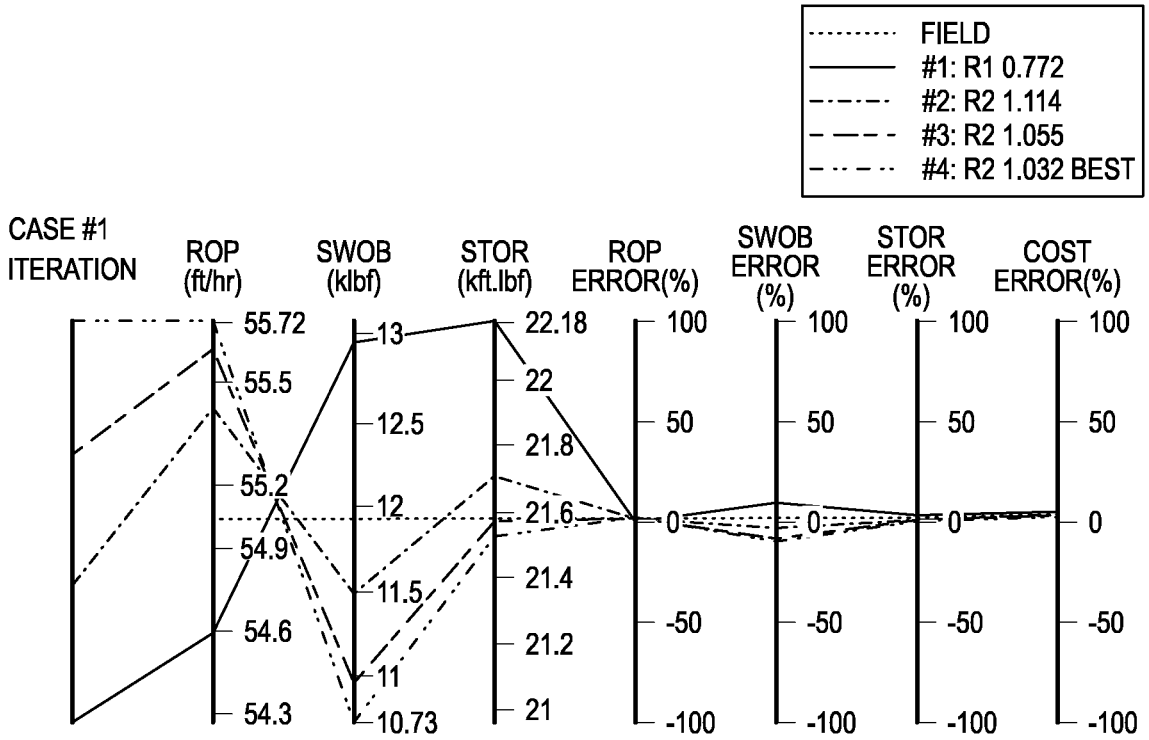
FIG. 12 illustrates a final validation result through several iterations, according to an embodiment.

FIG. 12 illustrates a final validation result through several iterations, according to an embodiment. More particularly, FIG. 12 shows the final validation result with the integrated model of the drill string and the bit-rock interactions with the calibrated friction factors and rocks with multipliers. Unfortunately, in this example, the result is out of a predetermined (e.g., acceptable) threshold. As a result, several iterations may be conducted between the rock and multiplier finder and the validation.

Calibration Result Summary

Figure 13A:
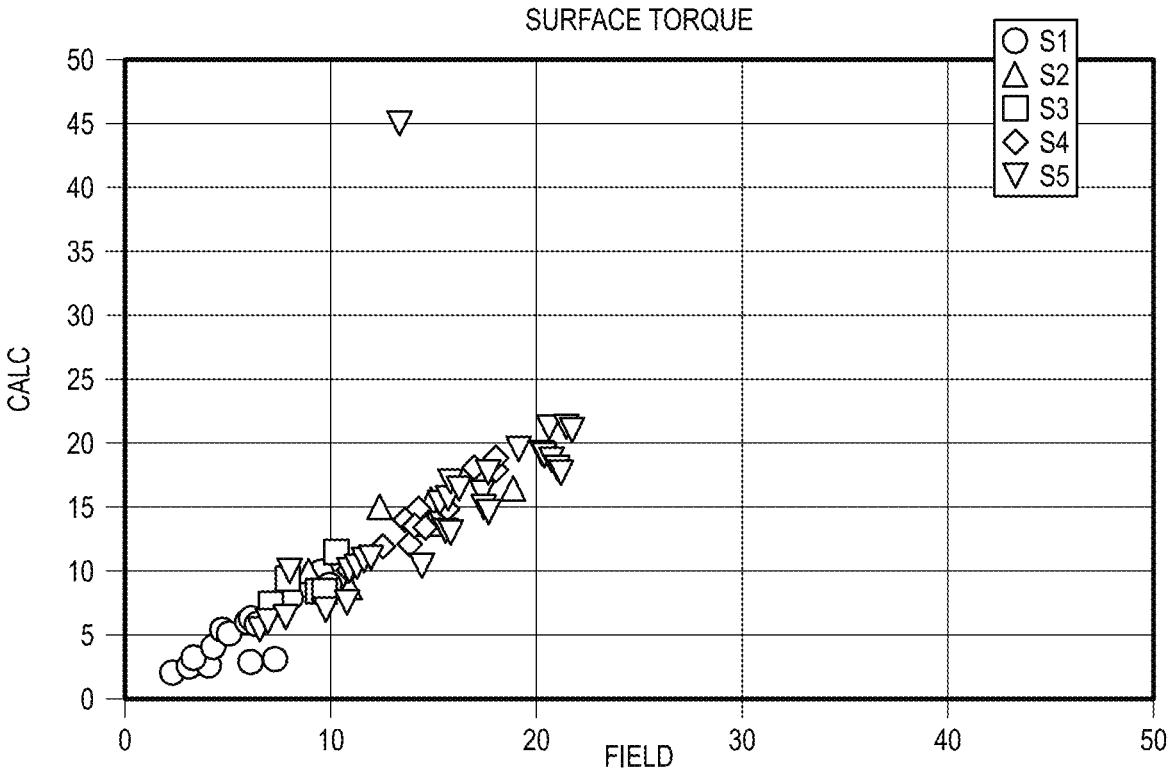
FIGS. 13A-13C illustrate graphs showing calibration results from multiple resources (e.g., wells), according to an embodiment.
Figure 13B:
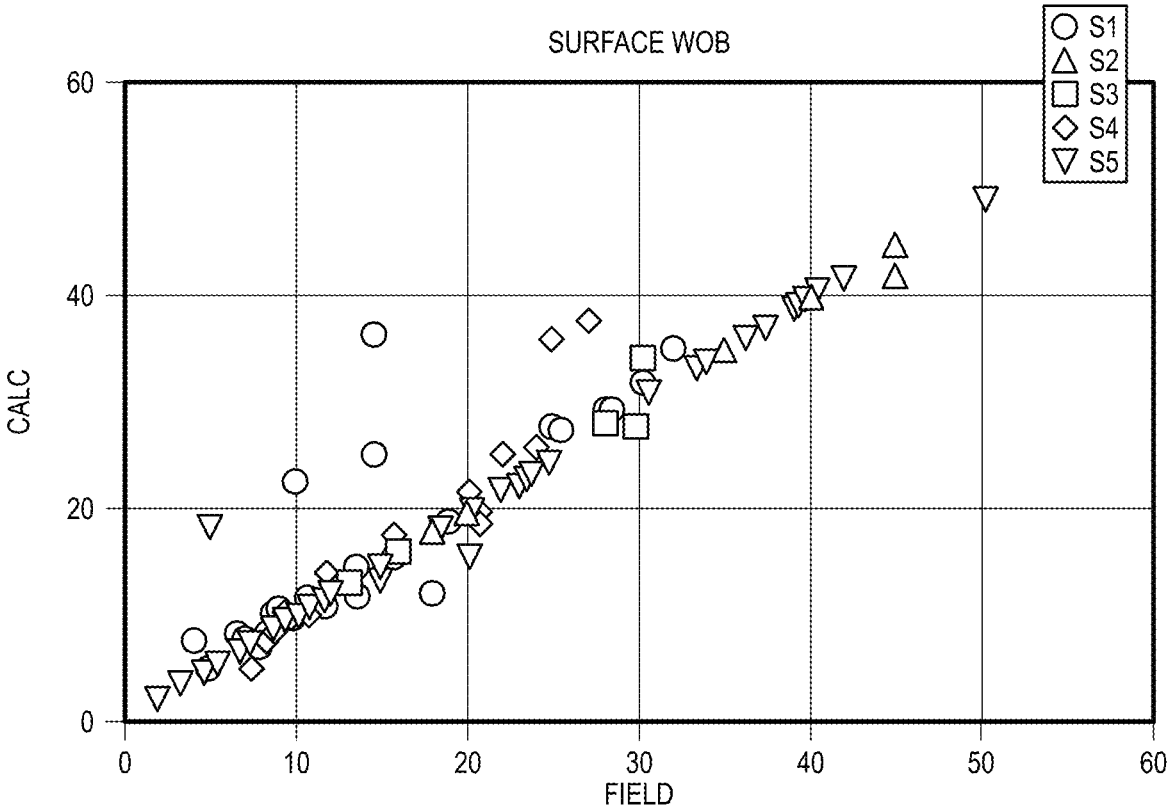
Figure 13C:
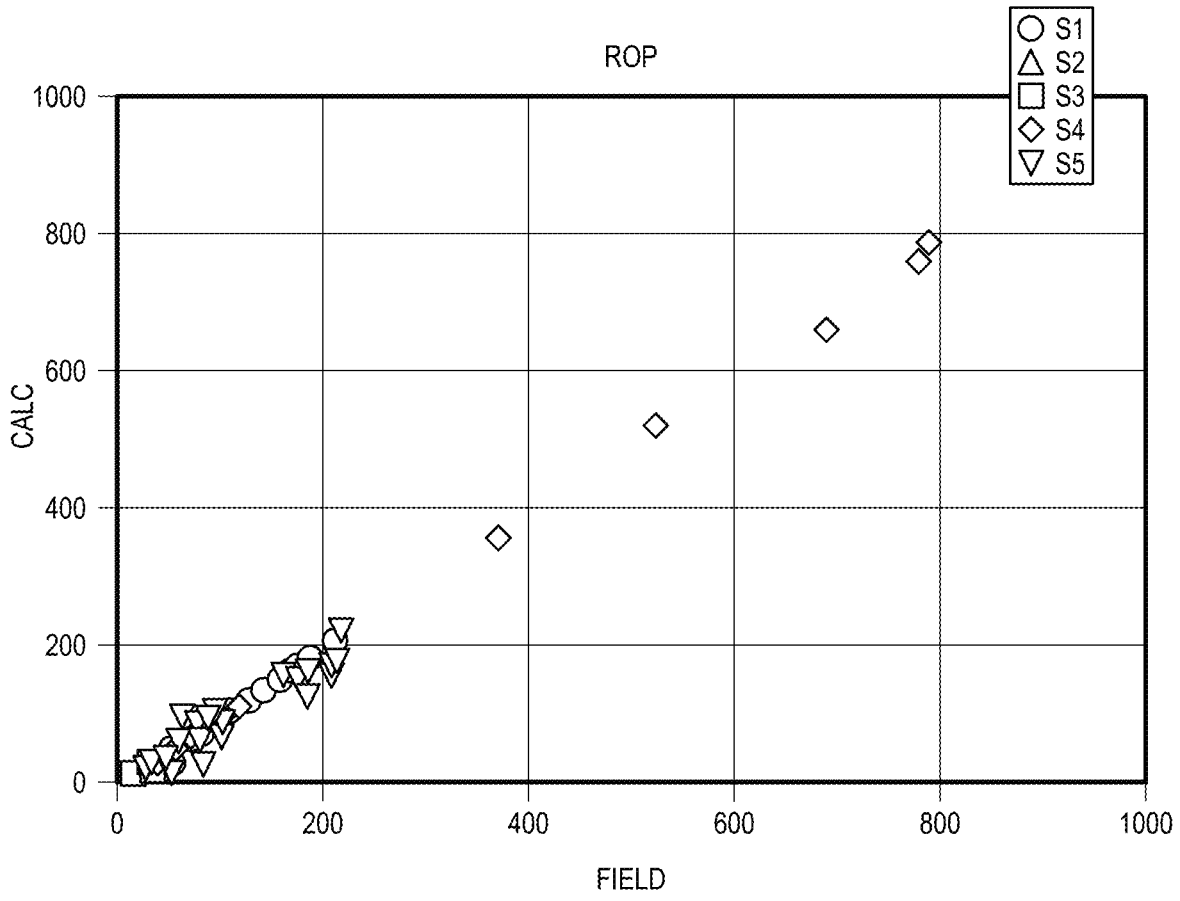

FIGS. 13A-13C illustrate graphs showing calibration results from multiple resources (e.g., wells), according to an embodiment. In these examples, the overall correlation is within a predetermined (e.g., acceptable) range, except several outliers.

The simulation may provide a benchmark for the cause analysis and the baseline for the improvements through the calibration. The data extraction method may be fit for the simulator and integrated into the whole workflow to reduce the human error. In addition, the simulation parameters may be changed to align the field measurements with the calibrated models. Furthermore, the downhole measurements may be matched, to reduce the likelihood of downhole failure.

The automated calibration workflow described herein calibrate a model, and matches simulation inputs with real field conditions, particularly in relation to formation description. By calibrating the rock model, issues related to limited access to rock samples and heterogeneity for lab testing can be overcome. Furthermore, the calibrated rock model can be retained and referenced for future offset analysis and prediction of the next well plan.

Additionally, the operator-oriented simulation workflow provided by the automated calibration process instills greater confidence in designing the proper bottom hole assembly (BHA) to prevent tool failure. It also facilitates the identification of the root causes of drilling dysfunctions. This automated calibration workflow offers advantages in terms of enhancing the accuracy and reliability of simulations, supporting decision-making processes, and improving drilling performance.

Calibrating Friction Factor and Rock Fracture Properties Based Upon Surface Measurements The present disclosure may be used to prepare one or more inputs for determining and/or calibrating a well friction factor and rock fracture properties (also referred to as rock files). The well friction factor and the rock files may reflect the actual physics both at the surface of a wellbore and downhole.

The system and method may determine the friction factor and the rock fracture properties (also referred to as rock files) based upon surface measurements.

The system and method may measure or determine one or more surface measurements at the top (e.g., surface) of a wellbore. The surface measurements may be or include the weight on the drill bit as measured at the surface (SWOB) and the torque on the drill bit as measured at the surface (STOR). The system and method may then use a torque and drag (T&D) analysis to determine one or more downhole measurements at a downhole tool (e.g., drill bit) in the wellbore. The downhole measurements may be or include the weight on the drill bit as measured in the wellbore and at the drill bit (DWOB) and the torque on the drill bit as measured in the wellbore and at the drill bit (DTOR).

Then, using a bit standalone analysis, one or more candidate rock files may be used to generate the corresponding behavior (e.g., BWOB, DTOR) of the drill bit when drilling through the rock types in the rock files. The system and method may then use a modification (e.g., optimization) to identify one of the rock files out of the plurality of rock files that creates the drill bit force that is closest to the transferred force (e.g., DWOB, DTOR).

Then, the difference between the surface measurements and the (e.g., simulated) downhole measurements may be determined (e.g., using a full dynamic drilling analysis). The difference may be reduced using a re-trigger mechanism. More particularly, the difference may be reduced by correcting the transferred measurements (e.g., DWOB, DTOR) by reconsidering the difference.

Figure 14:
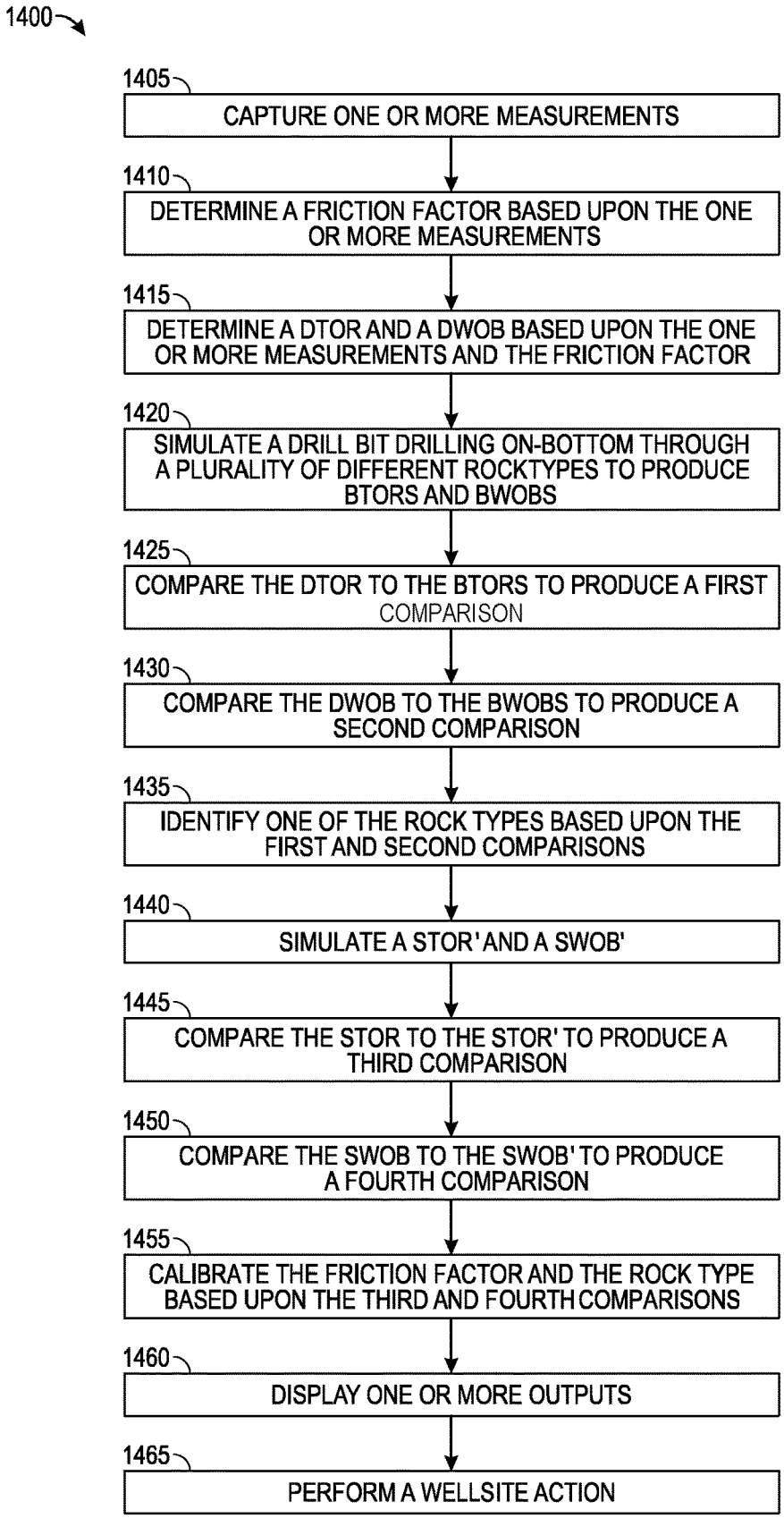
FIG. 14 illustrates a flowchart of a method for calibrating a model of a subterranean formation, according to an embodiment.
Figure 15A:
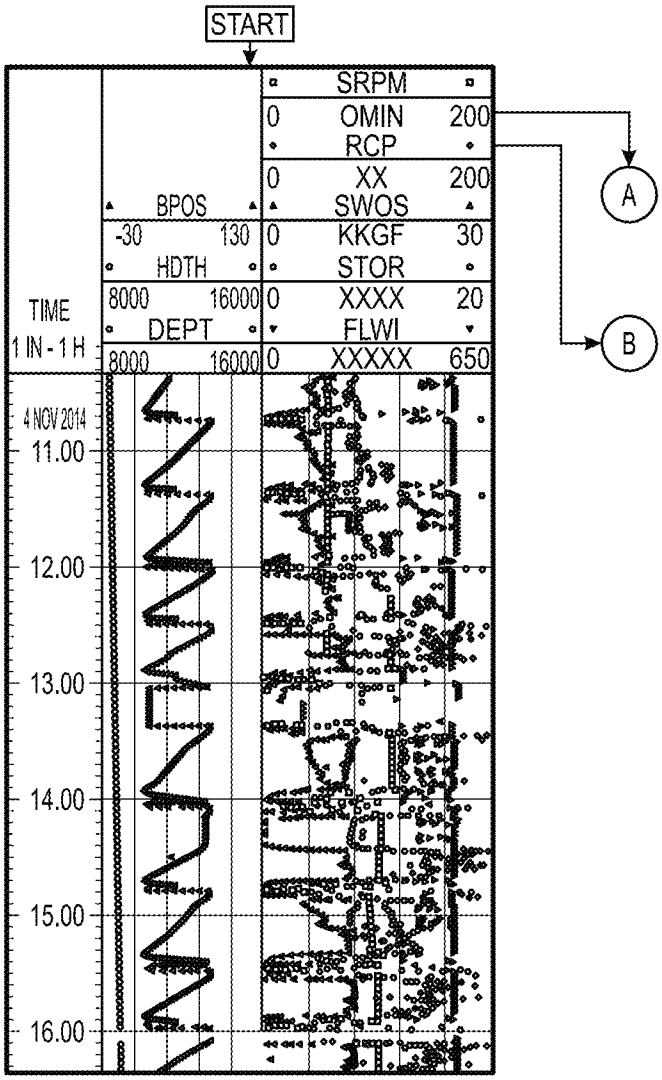
FIGS. 15A and 15B illustrate schematic views of the method, according to an embodiment.
Figure 15B:
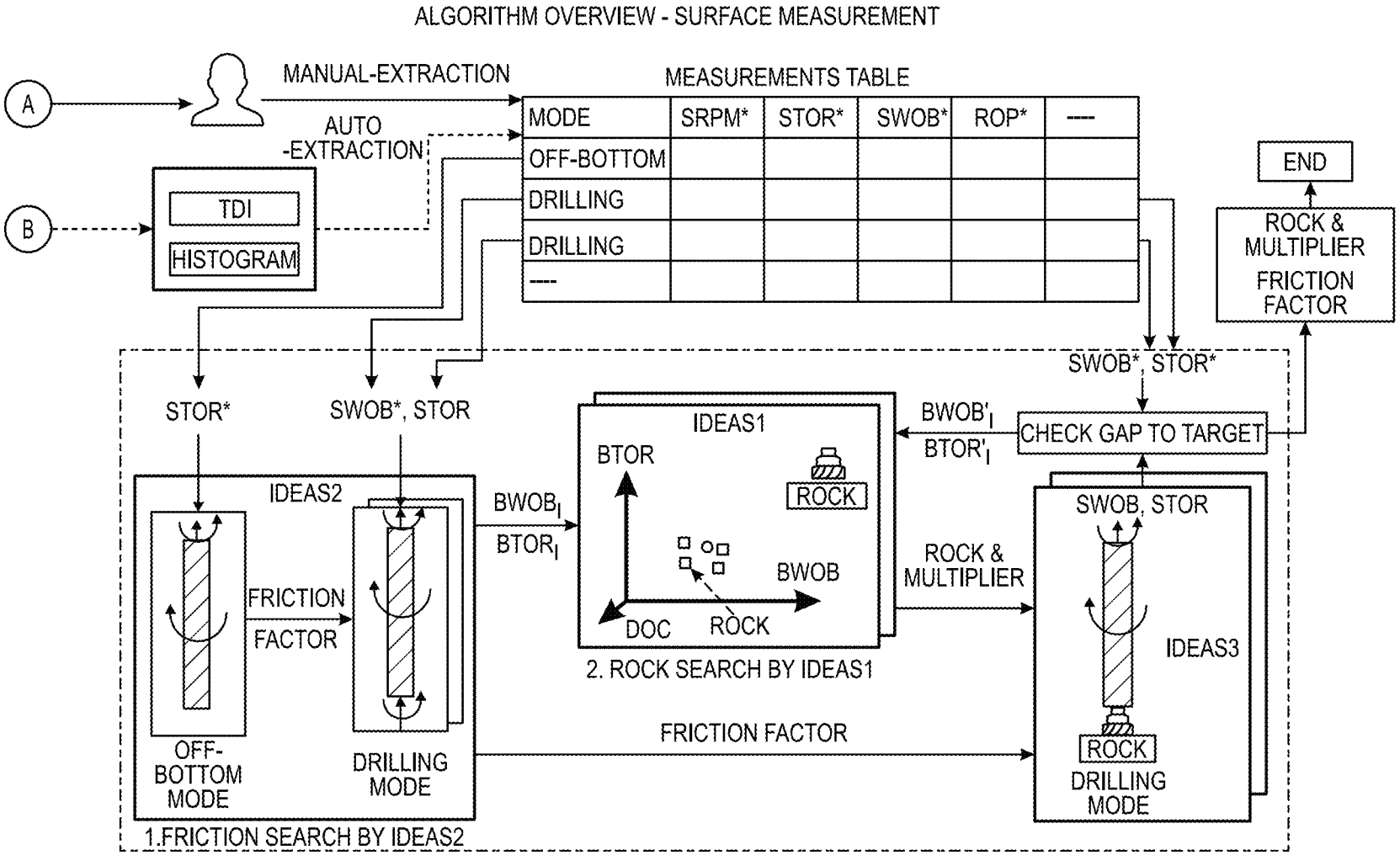

FIG. 14 illustrates a flowchart of a method 1400 for calibrating a model of a subterranean formation, according to an embodiment. More particularly, the method 1400 may be used to calibrate one or more rock types of the subterranean formation and/or a friction factor in a wellbore drilled into the subterranean formation. An illustrative order of the method 1400 is provided below; however, one or more portions of the method 1400 may be performed in a different order, simultaneously, repeated, or omitted. FIGS. 15A and 15B illustrate schematic views of at least a portion of the method 1400, according to an embodiment.

The method 1400 may include capturing one or more measurements at a surface of a wellbore, as at 1405. This is shown in FIGS. 15A and 15B. The measurements may include a number of rotations per minute (RPM) of a drill string that extends into the wellbore, a surface torque (STOR) on the drill string, a surface weight (SWOB) on the drill string, a rate of penetration (ROP) of the drill string, or a combination thereof.

Figure 16B:
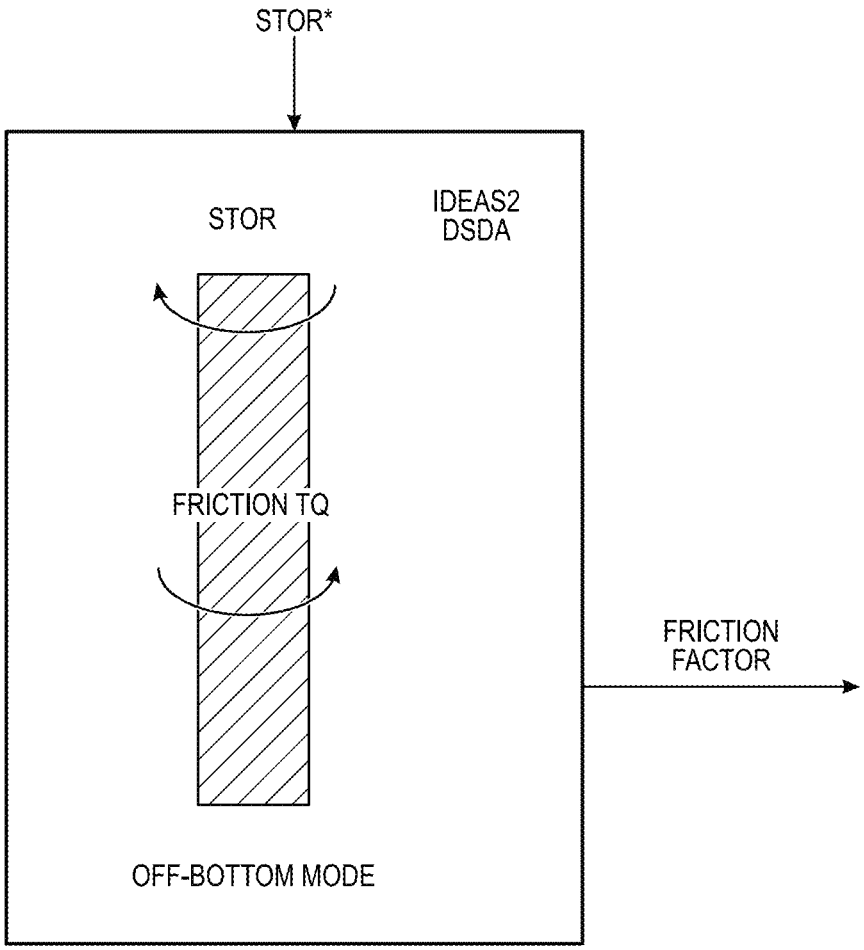
Figure 16C:
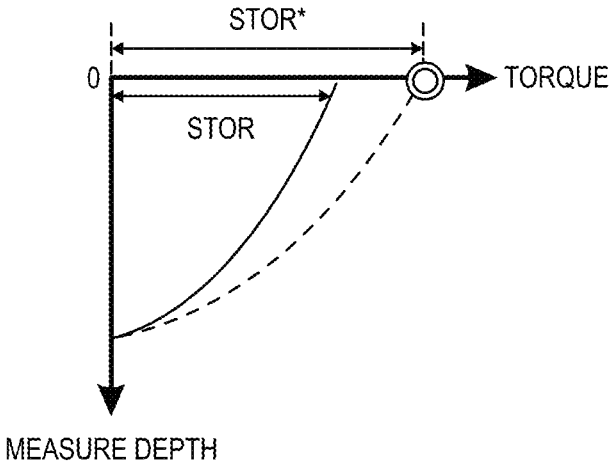

The method 1400 may also include determining a friction factor based upon the STOR, as at 1410. The friction factor may be determined when a drill bit is off-bottom in the wellbore. The drill bit may be coupled to a lower end of the drill string. This is shown in FIGS. 15A and 15B and FIGS. 16A-16C. FIGS. 16A-16C illustrate more detailed schematic views of a portion of the method (e.g., determining and/or calibrating the friction factor as the downhole tool transitions from an off-bottom mode), according to an embodiment. More particularly, FIG. 16A illustrates a schematic side view of a friction factor distribution between a cased portion and an open hole portion of a wellbore. FIG. 16B illustrates a schematic view showing the STOR when the drill bit is off-bottom in the wellbore. FIG. 16C illustrates a graph showing the STOR versus measured depth in the wellbore.

Figure 17A:
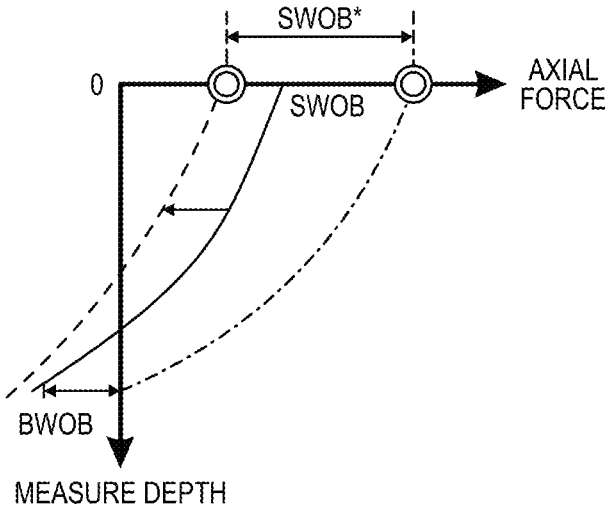
Figure 17B:
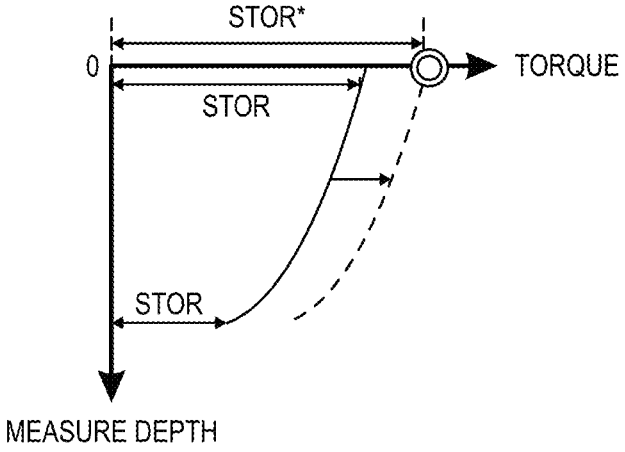

The method 1400 may also include determining a downhole torque on the drill bit (DTOR) and/or a downhole weight on the drill bit (DWOB), as at 1415. The DTOR and the DWOB may be determined when the drill bit is on-bottom in the wellbore. The DTOR and/or the DWOB may be determined based at least partially upon the STOR, the SWOB, and the friction factor. This is shown in FIGS. 15A and 15B and FIGS. 17A-17C. FIGS. 17A-17C illustrate more detailed schematic views of a portion of the method (e.g., predicting a weight on a drill bit (WOB) and torque on the drill bit based upon the friction factor), according to an embodiment. More particularly, FIG. 17A illustrates a graph showing a drag distribution along the drill string. FIG. 17B illustrates a graph showing a torque distribution along the drill string. FIG. 17C illustrates a schematic view showing SWOB, STOR, BWOB, and BTOR when the drill bit is drilling in the wellbore.

Figure 18:
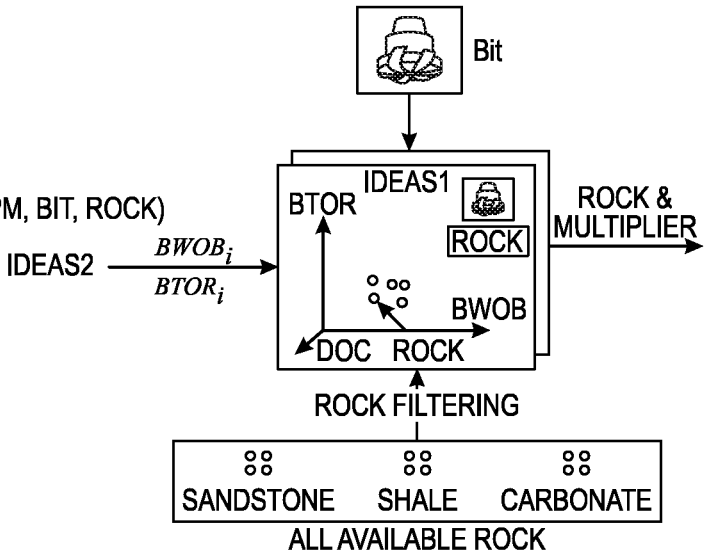
FIG. 18 illustrates a more detailed schematic view of a portion of the method (e.g., determining a rock type), according to an embodiment.

The method 1400 may also include simulating the drill bit drilling on-bottom through a plurality of different rock types in a model, as at 1420. The simulation may produce a plurality of simulated torques on the drill bit (BTORs) and/or a plurality of simulated weights on the drill bit (BWOBs). This is shown in FIGS. 15A and 15B and FIG. 18.

The method 1400 may also include comparing the DTOR to the BTORs to produce a first comparison, as at 1425. This is shown in FIGS. 15A and 15B.

The method 1400 may also include comparing the DWOB to the BWOBs to produce a second comparison, as at 1430. This is shown in FIGS. 15A and 15B.

The method 1400 may also include identifying one of the rock types based upon the first comparison and/or the second comparison, as at 1435. In one embodiment, the rock type may represent the rock forces against cutting depth etc., which may be determined in lab tests on rock samples and cutters. The rock sample may contain the lithology, grain/clast size, mineralogy, etc. However, those physical parameters may not be utilized in (e.g. IDEAS) modeling, except for the rock forces. For example, in IDEAS calibration, "rock types" (e.g., namely cutter forces) may be utilized to deduce bit torque and WOB from the cutters within bits. By comparing deduced bit WOB/torque to field measurements, the optimal "rock type" may be selected by the closest distance.

In another embodiment, the rock type may be or include the lithology (e.g., igneous, sedimentary, metamorphic), the grain/clast size, the mineralogy, the fabric, the textures, the structure, the rock fracture properties, or a combination thereof. Illustrative rock fracture properties may be or include continuity, cohesion, stress, fracture/fault size and/or location, permeability, rock strength, or a combination thereof.

Figure 19C:
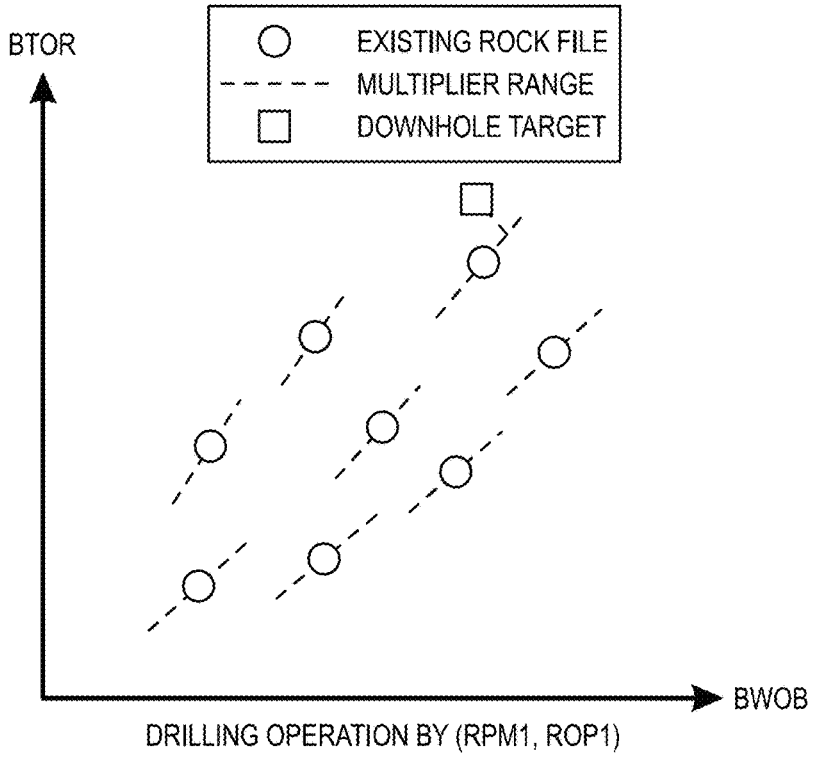
Figure 19D:
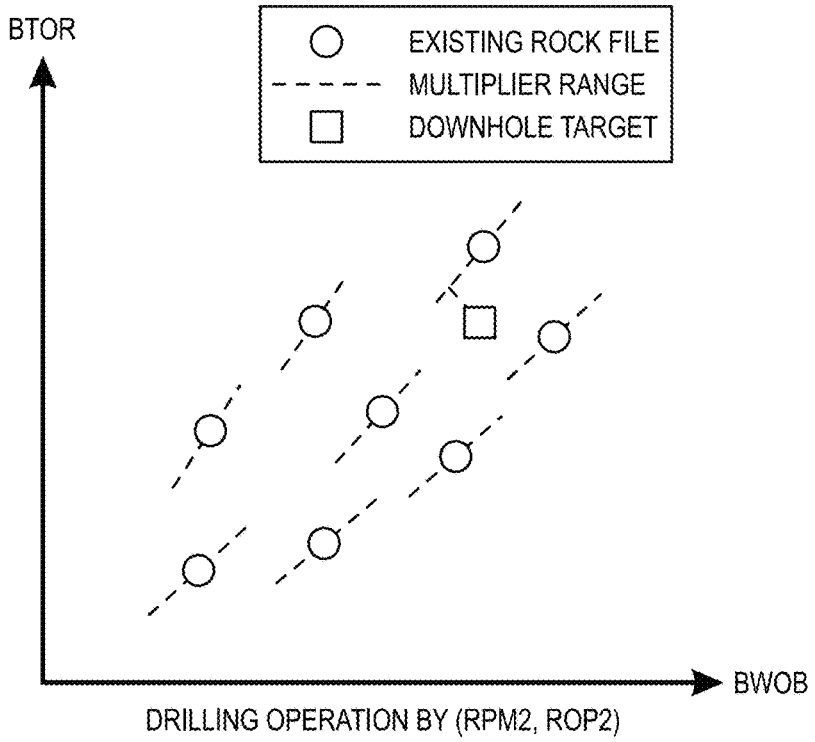
Figure 22A:
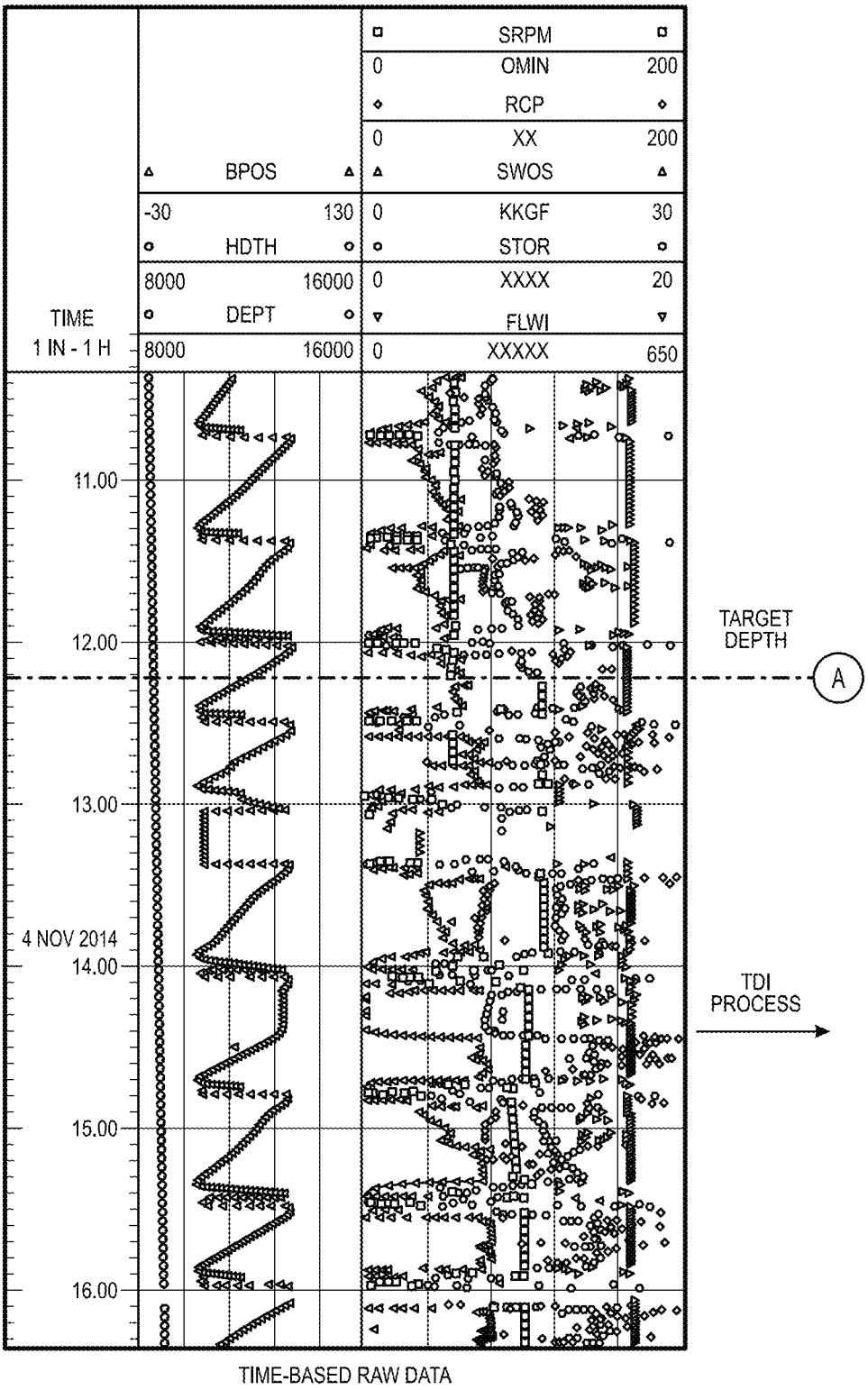
FIGS. 22A-22D illustrate more detailed schematic views of a portion of the method (e.g., analyzing drilling data of a stand), according to an embodiment.
Figure 22B:
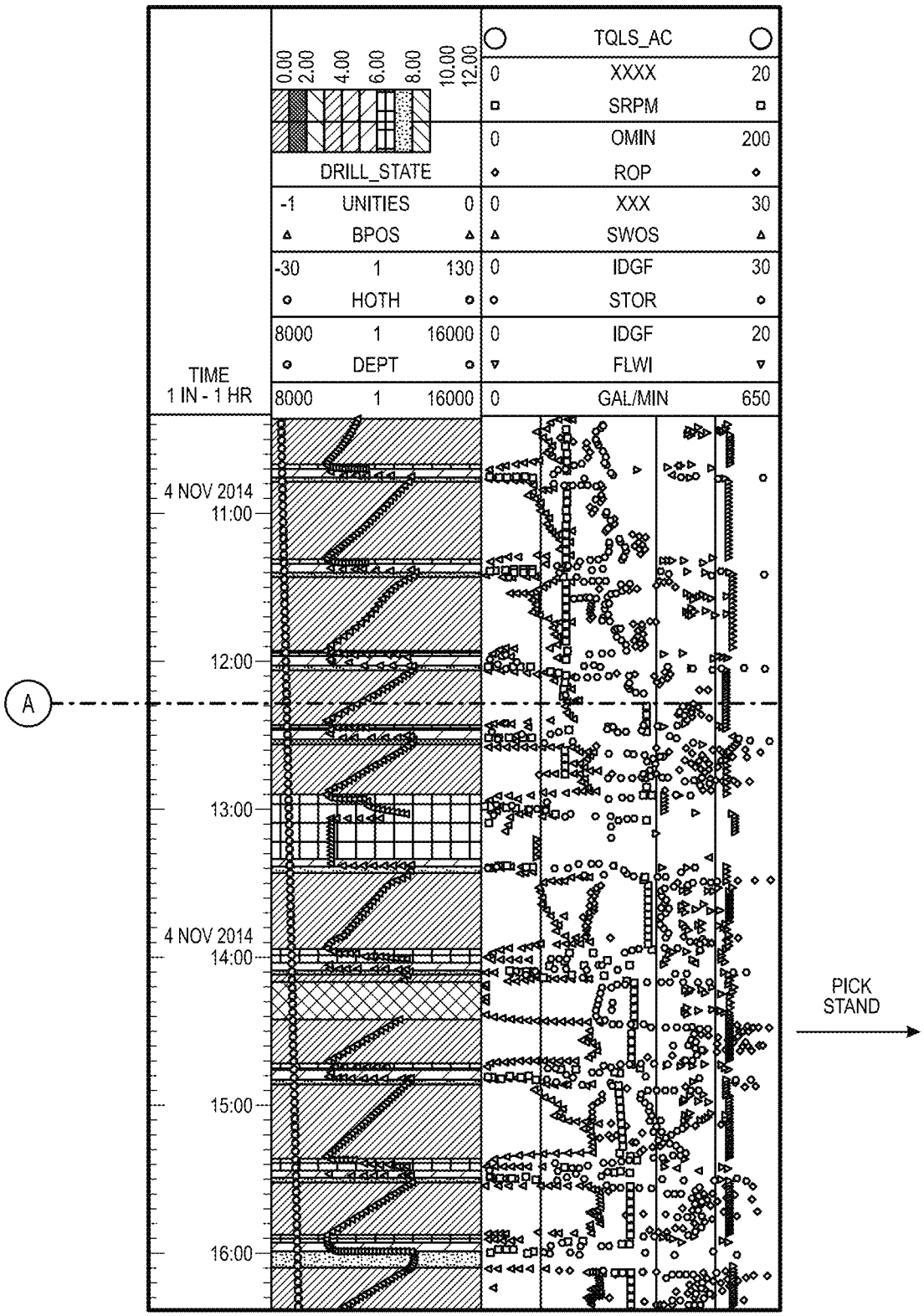
Figure 22C:
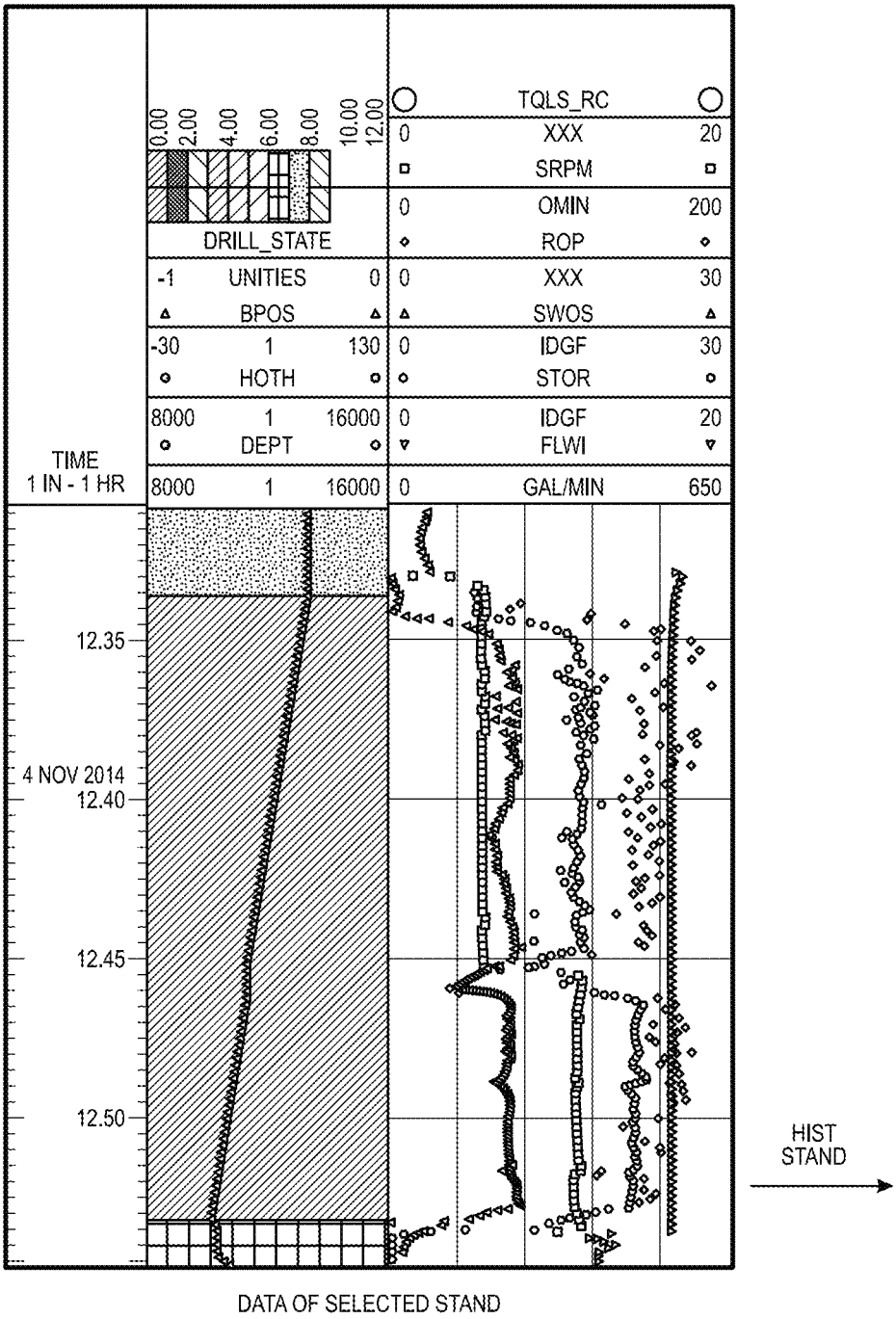
Figure 22D:
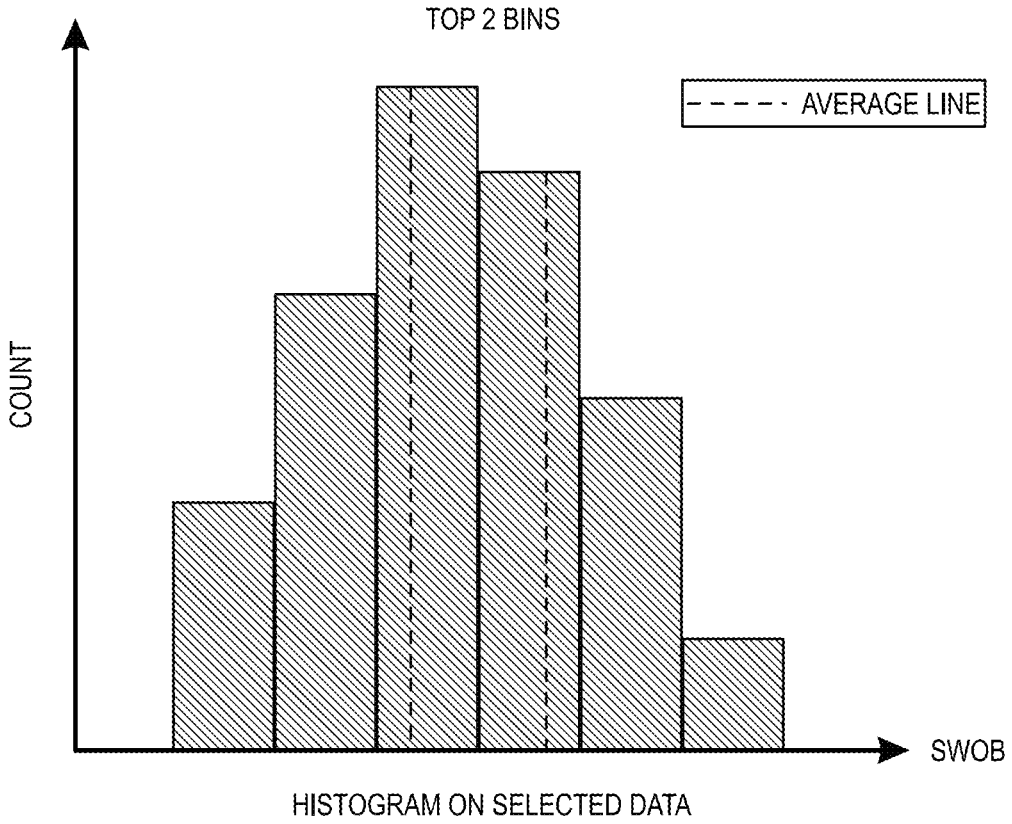

As mentioned above, the identified rock type may have a smallest difference between the DTOR and the BTORs, the DWOB and the BWOBs, or both. This is shown in FIGS. 15A and 15B and FIGS. 19A-19D. FIGS. 19A-19D illustrate schematic views of another method for identifying a rock type, according to an embodiment. More particularly, FIG. 19A illustrates a graph showing the cost of each rock file. FIG. 19B illustrates one or more (e.g., 3D) graphs showing BTOR and BWOB for each rock file. FIG. 19C illustrates a graph showing BTOR versus drilling operation by RPM1 and ROP1. FIG. 19D illustrates a graph showing BTOR versus drilling operation by RPM2 and ROP2.

The method 1400 may also include determining a simulated surface torque (STOR') on the drill string and/or a simulated surface weight (SWOB') on the drill string, as at 1440. The STOR' and/or the SWOB' may be determined based at least partially upon the identified rock type. This is shown in FIGS. 15A and 15B.

The method 1400 may also include comparing the STOR to the STOR' to produce a third comparison, as at 1445. This is shown in FIGS. 15A and 15B.

The method 1400 may also include comparing the SWOB to the SWOB' to produce a fourth comparison, as at 1450. This is shown in FIGS. 15A and 15B.

The method 1400 may also include calibrating the friction factor and/or the identified rock type, as at 1455. The calibration may be based upon the third comparison and/or the fourth comparison. This is shown in FIGS. 15A and 15B, FIGS. 20, 21A, 21B, and 22A-22D. FIG. 20 illustrates a schematic view of a method for verifying an accuracy of a determined friction factor and rock type, according to an embodiment. FIGS. 21A and 21B illustrate schematic views of a method for improving an accuracy of the selected rock type, according to an embodiment. FIGS. 22A-22D illustrate schematic views of a method for analyzing drilling data of a stand, according to an embodiment. More particularly, a TDI may be run. Then, a plurality of stands may be split based upon the drill state, and off-bottom data may be determined for each stand. The stand with the target depth may be selected. The drilling data from the selected stand may be analyzed to select one or more (e.g., two) sets of drilling data. Calibrating the rock type may include identifying the rock type with more specificity and/or confidence. Calibrating the rock type may also or instead include determining that the initial rock type is incorrect and determining the new/correct rock type.

The method 1400 may also include displaying one or more outputs, as at 1460. The outputs may be or include the friction factor, the DTOR, the DWOB, the BTORS, the BWOBS, the rock type(s), the STOR', the SWOB', the calibrated friction factor, the calibrated rock type, or a combination thereof.

The method 1400 may also include performing a wellsite action, as at 1465. The wellsite action may be based upon the friction factor, the DTOR, the DWOB, the BTORS, the BWOBS, the rock type(s), the STOR', the SWOB', the calibrated friction factor, the calibrated rock type, or a combination thereof. The wellsite action may be or include generating and/or transmitting a signal (e.g., using a computing system) that instructs or causes a physical action to occur at a wellsite. The wellsite action may also or instead include performing the physical action at the wellsite. The physical action may include varying the number of RPM, varying the STOR, varying the SWOB, varying the ROP, or a combination thereof.

Figure 23:
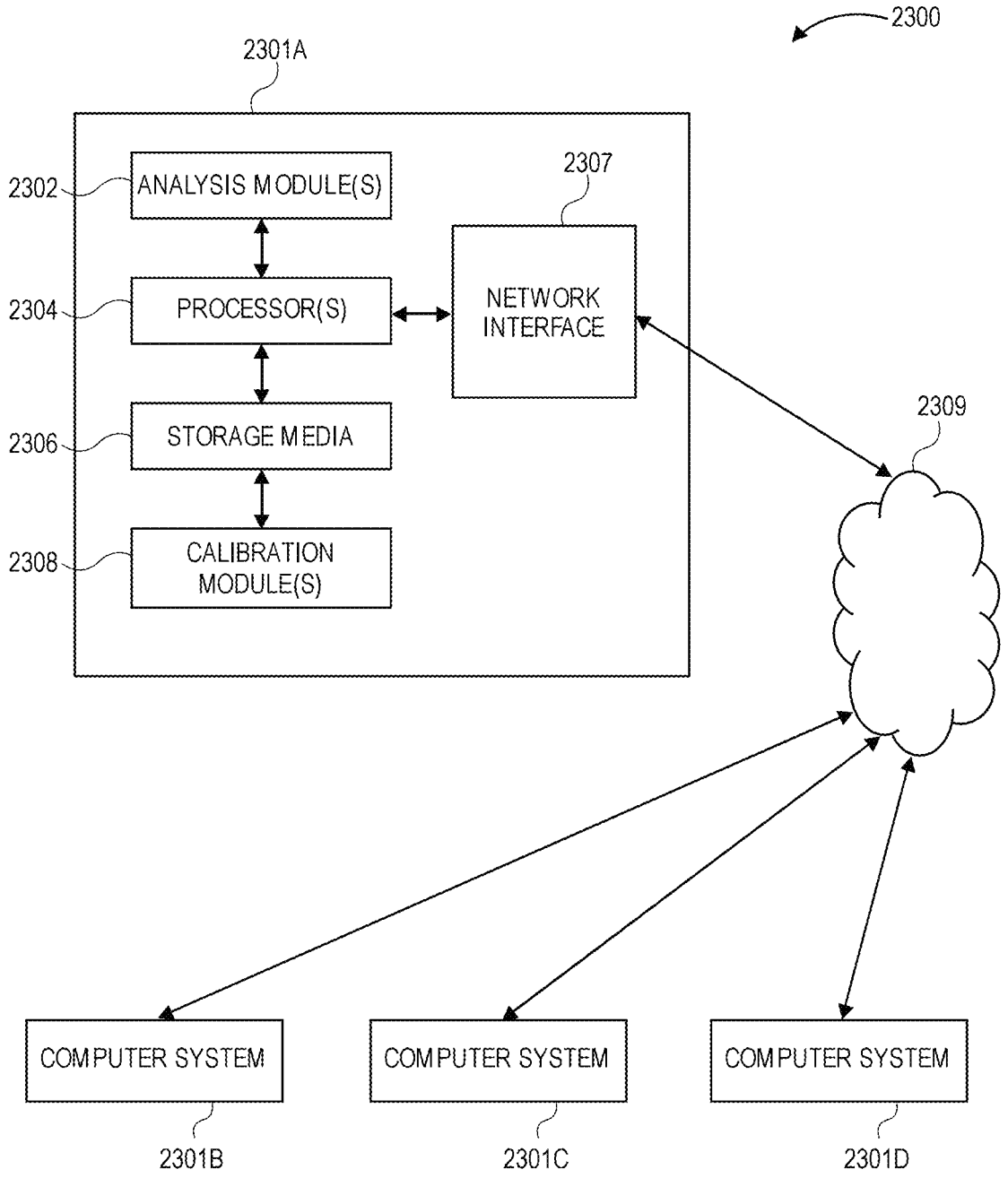
FIG. 23 illustrates a schematic view of a computing system, according to an embodiment.

In some embodiments, the methods of the present disclosure may be executed by a computing system. FIG. 23 illustrates an example of such a computing system 2300, in accordance with some embodiments. The computing system 2300 may include a computer or computer system 2301A, which may be an individual computer system 2301A or an arrangement of distributed computer systems. The computer system 2301A includes one or more analysis modules 2302 that are configured to perform various tasks according to some embodiments, such as one or more methods disclosed herein. To perform these various tasks, the analysis module 2302 executes independently, or in coordination with, one or more processors 2304, which is (or are) connected to one or more storage media 2306. The processor(s) 2304 is (or are) also connected to a network interface 2307 to allow the computer system 2301A to communicate over a data network 2309 with one or more additional computer systems and/or computing systems, such as 2301B, 2301C, and/or 2301D (note that computer systems 2301B, 2301C and/or 2301D may or may not share the same architecture as computer system 2301A, and may be located in different physical locations, e.g., computer systems 2301A and 2301B may be located in a processing facility, while in communication with one or more computer systems such as 2301C and/or 2301D that are located in one or more data centers, and/or located in varying countries on different continents).

A processor may include a microprocessor, microcontroller, processor module or subsystem, programmable integrated circuit, programmable gate array, or another control or computing device.

The storage media 2306 may be implemented as one or more computer-readable or machine-readable storage media. Note that while in the example embodiment of FIG. 23 storage media 2306 is depicted as within computer system 2301A, in some embodiments, storage media 2306 may be distributed within and/or across multiple internal and/or external enclosures of computing system 2301A and/or additional computing systems. Storage media 2306 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or may be provided on multiple computer-readable or machine-readable storage media distributed in a large system having possibly plural nodes. Such computer-readable or machine-readable storage medium or media is (are) considered to be part of an article (or article of manufacture).

An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, computing system 2300 contains one or more calibration module(s) 2308. In the example of computing system 2300, computer system 2301A includes the calibration module 2308. In some embodiments, a single calibration module may be used to perform some aspects of one or more embodiments of the methods disclosed herein. In other embodiments, a plurality of calibration modules may be used to perform some aspects of methods herein.

It should be appreciated that computing system 2300 is merely one example of a computing system, and that computing system 2300 may have more or fewer components than shown, may combine additional components not depicted in the example embodiment of FIG. 23, and/or computing system 2300 may have a different configuration or arrangement of the components depicted in FIG. 23. The various components shown in FIG. 23 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAS, PLDs, or other appropriate devices. These modules, combinations of these modules, and/or their combination with general hardware are included within the scope of the present disclosure.

Computational interpretations, models, and/or other interpretation aids may be refined in an iterative fashion; this concept is applicable to the methods discussed herein. This may include use of feedback loops executed on an algorithmic basis, such as at a computing device (e.g., computing system 2300, FIG. 23), and/or through manual control by a user who may make determinations regarding whether a given step, action, template, model, or set of curves has become sufficiently accurate for the evaluation of the subsurface three-dimensional geologic formation under consideration.

The foregoing description, for purpose of explanation, has been described with reference to specific embodiments. However, the illustrative discussions above are not intended to be exhaustive or limiting to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principles of the disclosure and its practical applications, to thereby enable others skilled in the art to best utilize the disclosed embodiments and various embodiments with various modifications as are suited to the particular use contemplated.

What is claimed is:

1. A method for calibrating a model of a subterranean formation, the method comprising:

capturing one or more measurements at a surface of a wellbore that extends into the subterranean formation, wherein the one or more measurements comprise a surface torque (STOR) on a drill string that extends into the wellbore;

determining a friction factor based upon the STOR when a drill bit is off-bottom in the wellbore, wherein the drill bit is coupled to a lower end of the drill string;

determining a downhole torque on the drill bit (DTOR) and a downhole weight on the drill bit (DWOB) when the drill bit is on-bottom in the wellbore;

identifying a rock type in the subterranean formation based at least partially upon the friction factor, the DTOR, and the DWOB, wherein the one or more measurements also comprise a surface weight (SWOB) on the drill string, and wherein the DTOR and the DWOB are determined based upon the STOR, the SWOB, and the friction factor; and performing a wellsite action in response to the rock type, wherein the wellsite action comprises varying the STOR, varying the SWOB on the drill string, varying a number of rotations per minute (RPM) of the drill string, varying a rate of penetration (ROP) of the drill string, or a combination thereof.

2. The method of claim 1, further comprising:

simulating the drill bit drilling on-bottom through a plurality of different rock types in the model to produce a plurality of simulated torques on the drill bit (BTORs), wherein the plurality of different rock types include the identified rock type; and comparing the DTOR to the BTORs to produce a comparison, wherein the rock type is identified based upon the comparison.

3. The method of claim 1, further comprising:

simulating the drill bit drilling on-bottom through a plurality of different rock types in the model to produce a plurality of simulated weights on the drill bit (BWOBs), wherein the plurality of different rock types include the identified rock type; and comparing the DWOB to the BWOBs to produce a comparison, wherein the rock type is identified based upon the comparison.

4. The method of claim 1, further comprising:

determining a simulated surface torque (STOR') on the drill string based upon the identified rock type;

comparing the STOR to the STOR' to produce a comparison; and calibrating the friction factor based upon the comparison.

5. The method of claim 1, further comprising:

determining a simulated surface torque (STOR') on the drill string based upon the identified rock type;

comparing the STOR to the STOR' to produce a comparison; and calibrating the rock type based upon the comparison.

6. The method of claim 1, further comprising:

determining a simulated surface weight (SWOB') on the drill string based upon the identified rock type;

comparing the SWOB to the SWOB' to produce a comparison; and calibrating the friction factor based upon the comparison.

7. The method of claim 1, further comprising:

determining a simulated surface weight (SWOB') on the drill string based upon the identified rock type;

comparing the SWOB to the SWOB' to produce a comparison; and calibrating the rock type based upon the comparison.

8. The method of claim 1, further comprising displaying the friction factor, the DTOR, the DWOB, and the rock type.

9. A computing system, comprising:

one or more processors; and a memory system comprising one or more non-transitory computer-readable media storing instructions that, when executed by at least one of the one or more processors, cause the computing system to perform operations, the operations comprising:

capturing one or more measurements at a surface of a wellbore that extends into a subterranean formation, wherein the one or more measurements comprise a surface torque (STOR) on a drill string that extends into the wellbore and a surface weight (SWOB) on the drill string;

determining a friction factor based upon the STOR when a drill bit is off-bottom in the wellbore, wherein the drill bit is coupled to a lower end of the drill string;

determining a downhole torque on the drill bit (DTOR) and a downhole weight on the drill bit (DWOB) when the drill bit is on-bottom in the wellbore, wherein the DTOR and the DWOB are determined based upon the STOR, the SWOB, and the friction factor;

identifying a rock type in the subterranean formation based at least partially upon the friction factor, the DTOR, and the DWOB;

simulating the drill bit drilling on-bottom through a plurality of different rock types in a model to produce a plurality of simulated torques on the drill bit (BTORs) and a plurality of simulated weights on the drill bit (BWOBs), wherein the plurality of different rock types include the identified rock type;

comparing the DTOR to the BTORs to produce a first comparison;

comparing the DWOB to the BWOBs to produce a second comparison, wherein the rock type is identified based upon the first comparison and the second comparison; and performing a wellsite action based upon the rock type, wherein the wellsite action comprises generating or transmitting a signal that adjusts the STOR, the SWOB on the drill string, a number of rotations per minute (RPM) of the drill string, a rate of penetration (ROP) of the drill string, or a combination thereof.

10. The computing system of claim 9, wherein the operations further comprise:

determining a simulated surface torque (STOR') on the drill string and a simulated surface weight (SWOB') on the drill string based upon the identified rock type;

calibrating the friction factor to produce a calibrated friction factor based at least partially upon the STOR'; and calibrating the rock type to produce a calibrated rock type based at least partially upon the SWOB'.

11. The computing system of claim 10, wherein the operations further comprise:

comparing the STOR to the STOR' to produce a first comparison;

comparing the SWOB to the SWOB' to produce a second comparison;

calibrating the friction factor to produce the calibrated friction factor based upon the first comparison and the second comparison; and calibrating the rock type to produce the calibrated rock type based upon the first comparison and the second comparison.

12. The computing system of claim 9, wherein the operations further comprise displaying the friction factor, the DTOR, the DWOB, and the rock type.

13. A non-transitory computer-readable medium storing instructions that, when executed by one or more processors of a computing system, cause the computing system to perform operations, the operations comprising:

capturing one or more measurements at a surface of a wellbore that extends into a subterranean formation, wherein the one or more measurements comprise a surface torque (STOR) on a drill string that extends into the wellbore, a number of rotations per minute (RPM) of the drill string, a rate of penetration (ROP) of the drill string, and a surface weight (SWOB) on the drill string;

determining a friction factor based upon the STOR when a drill bit is off-bottom in the wellbore, wherein the drill bit is coupled to a lower end of the drill string;

determining a downhole torque on the drill bit (DTOR) and a downhole weight on the drill bit (DWOB) when the drill bit is on-bottom in the wellbore, wherein the DTOR and the DWOB are determined based upon the STOR, the SWOB, and the friction factor;

simulating the drill bit drilling on-bottom through a plurality of different rock types in a model to produce a plurality of simulated torques on the drill bit (BTORs) and a plurality of simulated weights on the drill bit (BWOBs);

comparing the DTOR to the BTORs produce a first comparison;

comparing the DWOB to the BWOBs to produce a second comparison;

identifying one of the rock types based upon the first comparison and the second comparison, wherein the identified rock type has a smallest difference between the DTOR and the BTORs, the DWOB and the BWOBs, or both;

determining a simulated surface torque (STOR') on the drill string and a simulated surface weight (SWOB') on the drill string based upon the identified rock type;

comparing the STOR to the STOR' to produce a third comparison;

comparing the SWOB to the SWOB' to produce a fourth comparison;

calibrating the friction factor to produce a calibrated friction factor based upon the third comparison and the fourth comparison;

calibrating the rock type to produce a calibrated rock type based upon the third comparison and the fourth comparison; and performing a wellsite action based upon the calibrated friction factor and the calibrated rock type, wherein the wellsite action comprises generating or transmitting a signal that adjusts the number of RPM, the STOR, the SWOB, the ROP, or a combination thereof.

* * * * *